US009031391B2

(12) United States Patent
Kouketsu et al.

(10) Patent No.: US 9,031,391 B2
(45) **Date of Patent: *May 12, 2015**

(54) WOVEN MESH FORM LIQUID CONTROL APPARATUS

(71) Applicant: CKD Corporation, Komaki-shi, Aichi (JP)

(72) Inventors: Masayuki Kouketsu, Komaki (JP); Hiroshi Itafuji, Komaki (JP)

(73) Assignee: CKD Corporation, Komaki-shi, Aichi (JP)

( * ) Notice: Subject to any disclaimer, the term of this patent is extended or adjusted under 35 U.S.C. 154(b) by 310 days.

This patent is subject to a terminal disclaimer.

(21) Appl. No.: 13/630,987

(22) Filed: Sep. 28, 2012

(65) Prior Publication Data

US 2013/0081733 A1 Apr. 4, 2013

(30) Foreign Application Priority Data

Sep. 30, 2011 (JP) ..... 2011-215866
Jul. 5, 2012 (JP) ..... 2012-151627

(51) Int. Cl.
*H05B 3/60* (2006.01)
*B01B 1/00* (2006.01)

(52) U.S. Cl.
CPC ..... *B01B 1/005* (2013.01)

(58) Field of Classification Search
None
See application file for complete search history.

(56) References Cited

U.S. PATENT DOCUMENTS

| | | | | |
|---|---|---|---|---|
| 8,361,231 | B2 * | 1/2013 | Kouketsu et al. | 118/725 |
| 8,840,049 | B2 * | 9/2014 | Kouketsu et al. | 239/595 |
| 2005/0006609 | A1 | 1/2005 | Fukano | |
| 2007/0101940 | A1 | 5/2007 | Iizuka | |
| 2012/0180724 | A1 * | 7/2012 | Kouketsu et al. | 118/712 |
| 2013/0081712 | A1 * | 4/2013 | Kouketsu et al. | 137/334 |
| 2013/0193230 | A1 * | 8/2013 | Kouketsu et al. | 239/136 |
| 2013/0298834 | A1 * | 11/2013 | Kouketsu et al. | 118/726 |
| 2014/0015151 | A1 * | 1/2014 | Kouketsu et al. | 261/152 |

FOREIGN PATENT DOCUMENTS

| | | |
|---|---|---|
| JP | 49-52175 | 5/1974 |
| JP | 5-156448 | 6/1993 |
| JP | 6-132209 | 5/1994 |
| JP | 6-232035 | 8/1994 |
| JP | 7-47201 | 2/1995 |
| JP | 7-155584 | 6/1995 |
| JP | 9-152287 | 6/1997 |
| JP | 9-186107 | 7/1997 |
| JP | 10-337464 | 12/1998 |
| JP | 2001-295050 | 10/2001 |
| JP | 2002-228117 | 8/2002 |

(Continued)

OTHER PUBLICATIONS

U.S. Appl. No. 13/631,003, filed Sep. 28, 2012.

(Continued)

*Primary Examiner* — Thor Campbell
(74) *Attorney, Agent, or Firm* — Beyer Law Group LLP

(57) ABSTRACT

A liquid control apparatus that controls a spread of a liquid has a main body that has a supply subject surface onto which the liquid is supplied. The apparatus also has a mesh form body that is woven into a mesh form and provided to contact the supply subject surface and a guiding member that is provided to contact an opposite side of the mesh form body to the main body side.

19 Claims, 26 Drawing Sheets

(56) References Cited

FOREIGN PATENT DOCUMENTS

| | | |
|---|---|---|
| JP | 2004-115920 | 4/2004 |
| JP | 2005-57193 | 3/2005 |
| JP | 2006-352001 | 12/2006 |
| JP | 2008-263244 | 10/2008 |
| JP | 2009-38047 | 2/2009 |
| JP | 2009-194246 | 8/2009 |
| JP | 4673449 | 1/2011 |
| WO | WO 2004/092622 | 10/2004 |

OTHER PUBLICATIONS

International Search Report dated Nov. 29, 2011 from International Application No. PCT/JP2011/069960.

U.S. Appl. No. 13/945,710, filed Jul. 18, 2013.

* cited by examiner

WOVEN MESH FORM LIQUID CONTROL APPARATUS

CROSS-REFERENCE TO RELATED APPLICATIONS

The present application claims priority based on Japan Patent Application No. 2011-215866 filed on Sep. 30, 2011 and Japan Patent Application No. 2012-151627 filed on Jul. 5, 2012, and the entire contents of those applications are incorporated by reference in this specification.

BACKGROUND OF THE INVENTION

1. Field of the Invention

The present invention relates to a liquid control apparatus for controlling a spread of a liquid contacting a surface.

2. Description of the Related Art

In this type of liquid control apparatus, minute irregularities are formed on a heat storage plate by disposing to overlap meshes (mesh form bodies) on an upper surface of the heat storage plate (Japanese Patent Publication No. 4673449). According to the apparatus described in Japanese Patent Publication No. 4673449, a liquid supplied between the upper surface of the heat storage plate and the mesh is caused to spread by interfacial tension, and therefore the liquid can be supplied over a large surface area of the mesh.

In the apparatus described in Japanese Patent Publication No. 4673449, although the liquid can be caused to spread over the upper surface of the heat storage plate using the interfacial tension generated by the minute irregularities, there remains room for improvement in terms of causing the liquid contacting the surface to spread preferentially in a desired direction.

SUMMARY OF THE INVENTION

The present invention has been designed in consideration of these circumstances, and a main object thereof is to provide a liquid control apparatus with which a liquid contacting a surface can be caused to spread preferentially in a desired direction.

To achieve the object described above, the present invention employs following means.

First means is a liquid control apparatus controlling a spread of a liquid, including: a main body having a supply subject surface onto which the liquid is supplied; a mesh form body that is woven into a mesh form and provided to contact the supply subject surface; and a guiding member provided to contact an opposite side of the mesh form body with respect to the main body.

According to the configuration described above, the mesh form body is woven into mesh form and provided to contact the supply subject surface of the main body, and therefore a plurality of interfaces are formed between the supply subject surface and the mesh form body. As a result, the liquid supplied onto the supply subject surface is caused to spread over the supply subject surface by interfacial tension between the plurality of interfaces.

Here, the guiding member is provided to contact the mesh form body on the side opposite to the main body, and therefore, a plurality of interfaces are also formed between the mesh form body and the guiding member. Hence, the liquid can also be caused to spread between the mesh form body and the guiding member by interfacial tension. Hence, spreading of the liquid can be promoted in the part provided with the guiding member over other parts. As a result, by adjusting the arrangement of the guiding member, the liquid contacting the supply subject surface can be caused to spread preferentially in a desired direction.

The above and other objects, features, and advantages of the present invention will be apparent from the following description when taken in conjunction with the accompanying drawings which illustrate preferred embodiments of the present invention by way of example.

DESCRIPTION OF THE PREFERRED EMBODIMENTS

An embodiment will be described below with reference to the drawings. This embodiment is realized as a liquid vaporizer that vaporizes a chemical, mixes the vaporized chemical with an inert gas, and discharges the resulting mixture.

Figure 1A:
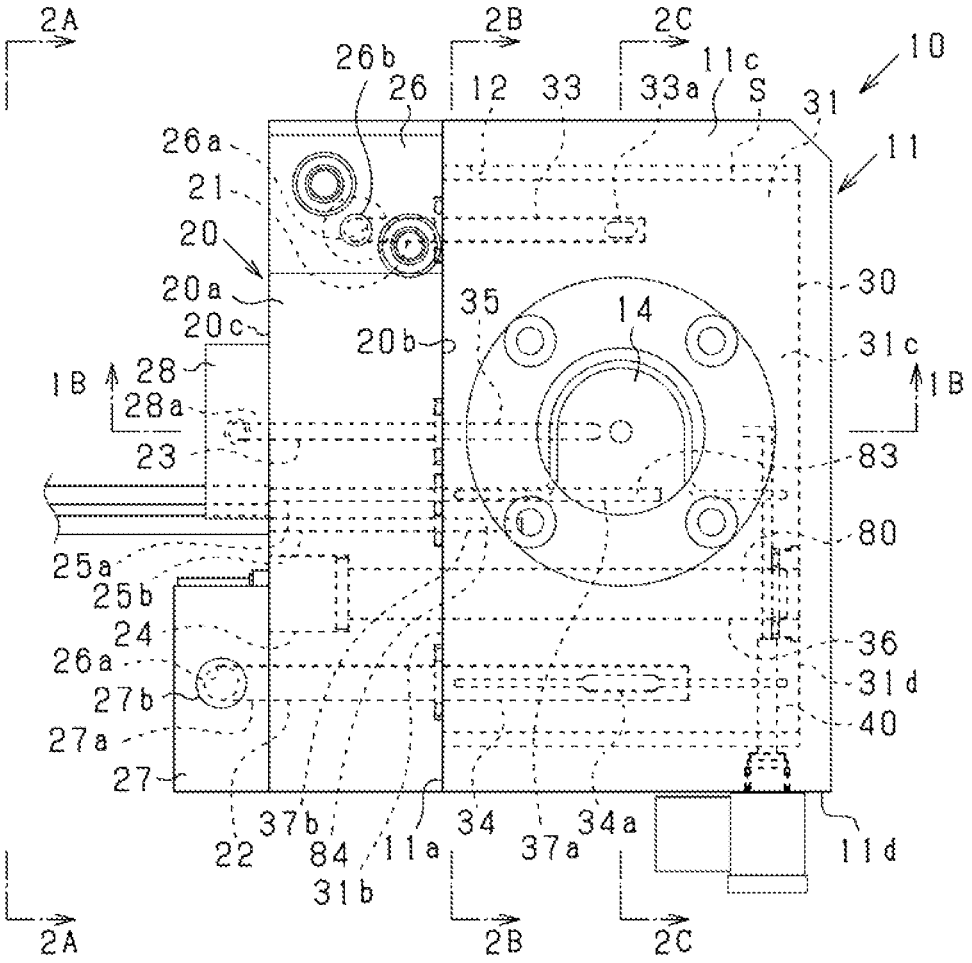
FIG. 1A is a plan view showing a liquid vaporizer.
Figure 1B:
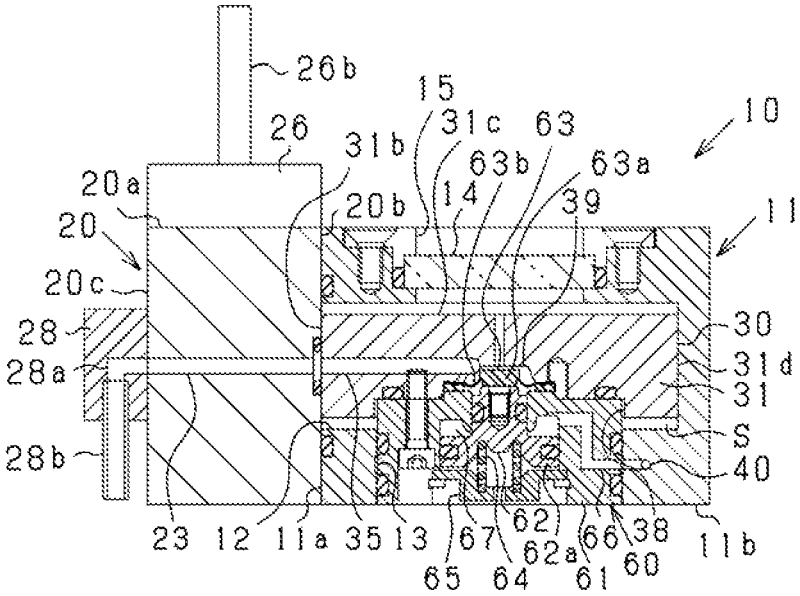
FIG. 1B is a sectional view taken along a 1B-1B line in FIG. 1A.

FIG. 1A is a plan view showing a liquid vaporizer 10, and FIG. 1B is a sectional view taken along a 1B-1B line in FIG. 1A. As shown in the drawings, the liquid vaporizer 10 includes a first housing 11, a second housing 20, a liquid control apparatus 30, a valve apparatus 60, a heater 80, thermocouples 83 and 84, and so on.

Figure 2A:
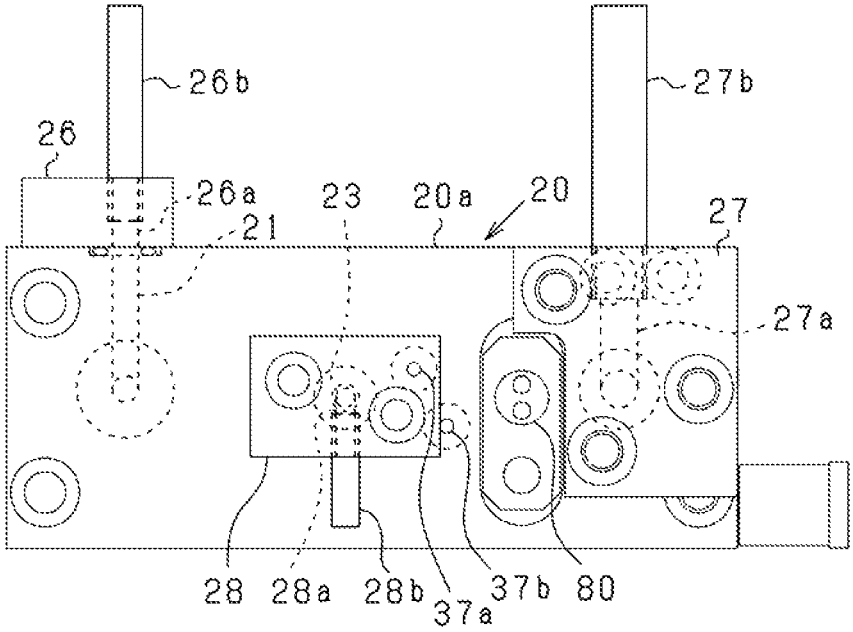
FIG. 2A is a side view showing a second housing from a 2A-2A line in FIG. 1A.
Figure 2B:
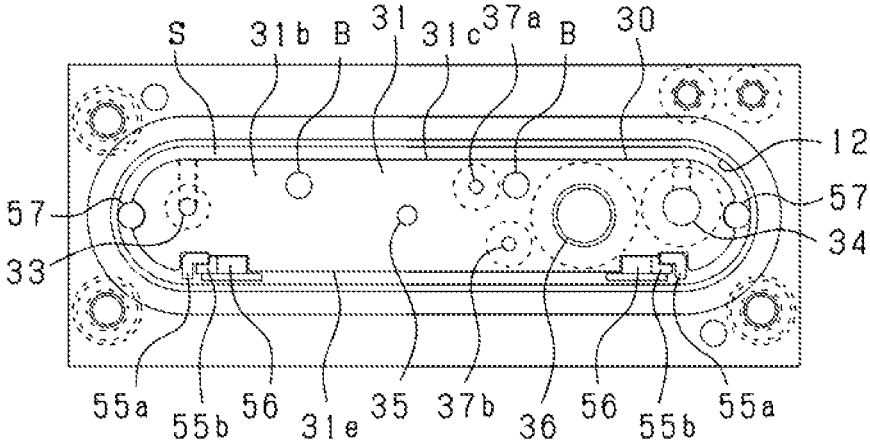
FIG. 2B is a sectional view taken along a 2B-2B line in FIG. 1A.

The first housing 11 is formed in the shape of a hollow rectangular parallelepiped, and a columnar space S having an oval bottom surface is formed in an interior thereof (refer to FIG. 2B). The columnar space S opens onto a side face 11*a* of the first housing 11 through an oval opening portion 12. An insertion hole 13 for inserting the valve apparatus 60 is formed in a lower surface 11*b* of the first housing 11. An attachment hole 15 for attaching a glass plate 14 is formed in an upper surface 11*c* of the first housing 11.

The liquid control apparatus 30 is inserted into the columnar space S through the opening portion 12 (refer to FIG. 2B). Further, the valve apparatus 60 is inserted into the insertion hole 13. The first housing 11 and the valve apparatus 60 are sealed from each other by a sealing member. The glass plate 14 is attached to the attachment hole 15 by a fastening member. The first housing 11 and the glass plate 14 are sealed from each other by a sealing member. An operator can observe the interior of the first housing 11 from above via the glass plate 14.

FIG. 2A is a side view showing the second housing 20 from a 2A-2A line in FIG. 1A. Referring also to FIG. 2A, the second housing 20 is formed in the shape of a rectangular parallelepiped and attached to the side face 11*a* of the first housing 11. The first housing 11 and the second housing 20 are sealed from each other by a sealing member. In the second housing 20, a surface that opposes the side face 11*a* of the first housing 11 serves as a side face 20*b*. A first gas flow passage 21, a second gas flow passage 22, a chemical flow passage 23, a heater insertion hole 24, and thermocouple insertion holes 25*a* and 25*b* are formed in the second housing 20.

The first gas flow passage 21 penetrates the second housing 20 from the side face 20*b* to an upper surface 20*a*. The second gas flow passage 22 penetrates from the side face 20*b* to a side face 20*c* opposite to the side face 20*b*. The first gas flow passage 21 and the second gas flow passage 22 are provided in positions close to respective ends of the upper surface 20*a* in a lengthwise direction thereof. The chemical flow passage 23 penetrates from the side face 20*b* to the side face 20*c* substantially in a center of the side face 20*b* and the side face 20*c*. The heater insertion hole 24 penetrates from the side face 20*b* to the side face 20*c* between the second gas flow passage 22 and the chemical flow passage 23. The thermocouple insertion holes 25*a* and 25*b* penetrate from the side face 20*b* to the side face 20*c* between the chemical flow passage 23 and the heater insertion hole 24.

A first block 26, a second block 27, and a chemical block 28 are attached to the second housing 20 by fastening members or the like.

The first block 26 is attached to the upper surface 20*a* of the second housing 20. A first block flow passage 26*a* is provided in the first block 26 to penetrate from a lower surface to an upper surface thereof. One end of the first block flow passage 26*a* is connected to the first gas flow passage 21. A first gas pipe 26*b* is connected to the other end of the first block flow passage 26*a*. Gas is introduced into the first block 26 from the first gas pipe 26*b*.

The second block 27 is attached to the side face 20*c* of the second housing 20. A second block flow passage 27*a* is provided in the second block 27 to penetrate from a side face to an upper surface thereof. One end of the second block flow passage 27*a* is connected to the second gas flow passage 22. A second gas pipe 27*b* is connected to the other end of the second block flow passage 27*a*. Gas is discharged from the second block 27 into the second gas pipe 27*b*.

The chemical block 28 is attached to the side face 20*c* of the second housing 20. A chemical block flow passage 28*a* is provided in the chemical block 28 to penetrate from a side face of the chemical block 28 to a lower surface thereof. One end of the chemical block flow passage 28*a* is connected to the chemical flow passage 23. A chemical pipe 28*b* is connected to the other end of the chemical block flow passage 28*a*. A chemical is introduced into the chemical block 28 from the chemical pipe 28*b*.

Figure 2C:
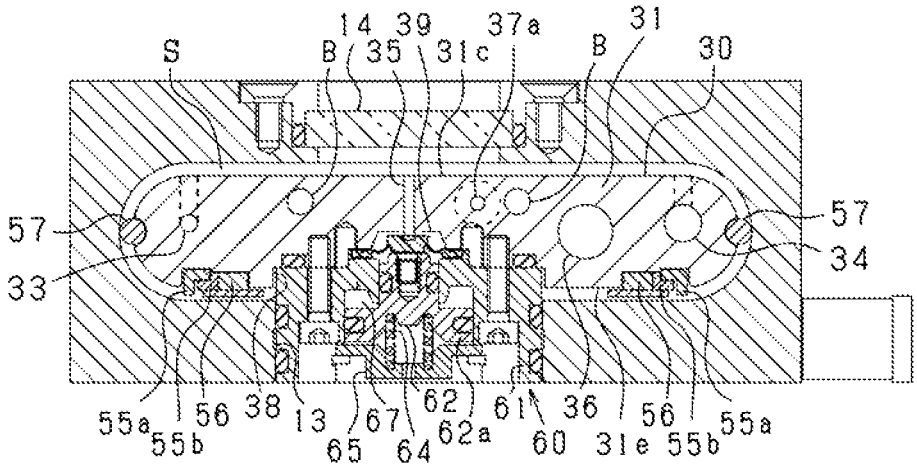
FIG. 2C is a sectional view taken along a 2C-2C line in FIG. 1A.

FIGS. 2B and 2C are a sectional view taken along a 2B-2B line in FIG. 1A and a sectional view taken along a 2C-2C line in FIG. 1A, respectively. Referring also to FIGS. 2B and 2C, the liquid control apparatus 30 includes a main body 31.

The main body 31 is formed in a columnar shape having an oval bottom surface so as to correspond to the columnar space S, and is formed to be slightly smaller than the columnar space S. As described above, the liquid control apparatus 30 is inserted into the columnar space S in the first housing 11 through the opening portion 12. The liquid control apparatus 30 is attached to the side face 20*b* of the second housing 20 using a fastening member in a through hole B formed in the main body 31. As a result, a gap having an oval tubular shape is formed between an inner peripheral surface of the first housing 11 and the main body 31. In the main body 31, a surface opposing the side face 20*b* of the second housing 20 serves as a side face 31*b*.

A first main body flow passage 33, a second main body flow passage 34, a chemical flow passage 35, a heater insertion hole 36, thermocouple insertion holes 37*a*, 37*b*, and a recessed portion 38 are formed in the main body 31.

The first main body flow passage 33 penetrates the main body 31 from a side face of the main body 31 to an upper surface thereof. One end of the first main body flow passage 33 is connected to the first gas flow passage 21. The other end of the first main body flow passage 33 opens substantially onto a center of the main body 31 in a direction extending from the second housing 20 to the first housing 11 (a widthwise direction of an upper surface 31*c* of the main body 31).

The second main body flow passage 34 penetrates the main body 31 from the side face to the upper surface thereof. One end of the second main body flow passage 34 is connected to the second gas flow passage 22. The other end of the second main body flow passage 34 opens substantially onto the center of the main body 31 in the widthwise direction of the upper surface 31*c* of the main body 31. The first main body flow passage 33 and the second main body flow passage 34 are provided in positions close to respective ends of the upper surface 31*c* in a lengthwise direction thereof.

The chemical flow passage 35 penetrates the main body 31 from the side face 31*b* to the upper surface 31*c* thereof. One end of the chemical flow passage 35 is connected to the chemical flow passage 23. The other end of the chemical flow passage 35 opens substantially onto the center of the main body 31 in the widthwise direction of the upper surface 31*c* of the main body 31.

The heater insertion hole 36 is connected to the heater insertion hole 24, and extends from the side face 31*b* to the vicinity of a side face 31*d* opposite to the side face 31*b*. The heater 80 is inserted into the heater insertion holes 24 and 36, and the upper surface 31*c* is heated by the heater 80.

The thermocouple insertion hole 37*a* is connected to the thermocouple insertion hole 25*a*, and extends substantially to the center of the main body 31 in the widthwise direction of the upper surface 31*c* of the main body 31. The thermocouple insertion hole 37*a* is formed in the main body 31 in the vicinity of the upper surface 31*c*. The first thermocouple 83 (a temperature sensor) is inserted into the thermocouple insertion holes 25*a* and 37*a*, and a temperature in the vicinity of the upper surface 31*c* is detected by the first thermocouple 83.

The thermocouple insertion hole 37*b* is connected to the thermocouple insertion hole 25*b*, and extends to a position before the center of the main body 31 (approximately a ¼ position) in the widthwise direction of the upper surface 31*c* of the main body 31. The thermocouple insertion hole 37*b* is formed in the main body 31 in a position close to a lower surface 31*e*. The second thermocouple 84 (a temperature sensor) is inserted into the thermocouple insertion holes 25*b* and 37*b*, and a temperature in a position close to the lower surface 31*e* is detected by the second thermocouple 84.

The recessed portion 38 is formed in the main body 31 in a position opposing the insertion hole 13 in the first housing 11. The valve apparatus 60 is inserted into the insertion hole 13 and the recessed portion 38 and attached to the main body 31 by a fastening member or the like. The main body 31 and the valve apparatus 60 are sealed from each other by a sealing member. The recessed portion 38 communicates with the chemical flow passage 35. A valve seat 39 is provided in a communicating part between the chemical flow passage 35 and the recessed portion 38. A working gas flow passage 40 is formed in the main body 31. The working gas flow passage 40 extends in the lengthwise direction of the upper surface 11*c* of the first housing 11 from a side face 11*d* of the first housing 11 substantially to a center of the first housing 11, then turns in the widthwise direction of the upper surface 11*c* so as to communicate with the insertion hole 13. A control unit of the liquid control apparatus 30 controls introduction and discharge of a working gas into and from the working gas flow passage 40.

The valve apparatus 60 includes a main body 61, a piston 62, a diaphragm valve body 63, a spring 64, a spring retainer 65, and so on.

The main body 61 is formed in a cylindrical shape, and the piston 62 is housed in an interior thereof. The main body 61 and the piston 62 have matching central axes.

The piston 62 is supported by the main body 61 to be capable of sliding in a central axis direction. The main body 61 and the first housing 11, the main body 61 and the main body 31 of the liquid control apparatus 30, and the main body 61 and the piston 62 are respectively sealed from each other by sealing members.

A valve main body 63*a* of the diaphragm valve body 63 is attached to a tip end of the piston 62. An outer edge portion of a diaphragm 63*b* of the diaphragm valve body 63 is sandwiched between the main body 31 of the liquid control apparatus 30 and the main body 61.

One end of the spring 64 impinges on the piston 62, and the other end of the spring 64 is supported by the spring retainer 65. The piston 62 is biased toward the valve seat 39 by the spring 64. Hence, in a natural state, the valve main body 63*a* of the diaphragm valve body 63 is pressed against the valve seat 39 such that the chemical flow passage 35 is blocked.

A working gas flow passage 66 is formed in the main body 61. One end of the working gas flow passage 66 is connected to the working gas flow passage 40 in the first housing 11. The other end of the working gas flow passage 66 communicates with a pressurization chamber 67 formed in the main body 61 on a side opposite to the spring 64 across a flange portion 62*a* of the piston 62. When the working gas is introduced through the working gas flow passages 40 and 66, the piston 62 is moved in a direction heading away from the valve seat 39. As a result, the chemical flow passage 35 is opened such that the chemical is supplied to the upper surface 31*c* of the main body 31 of the liquid control apparatus 30.

Figure 3:
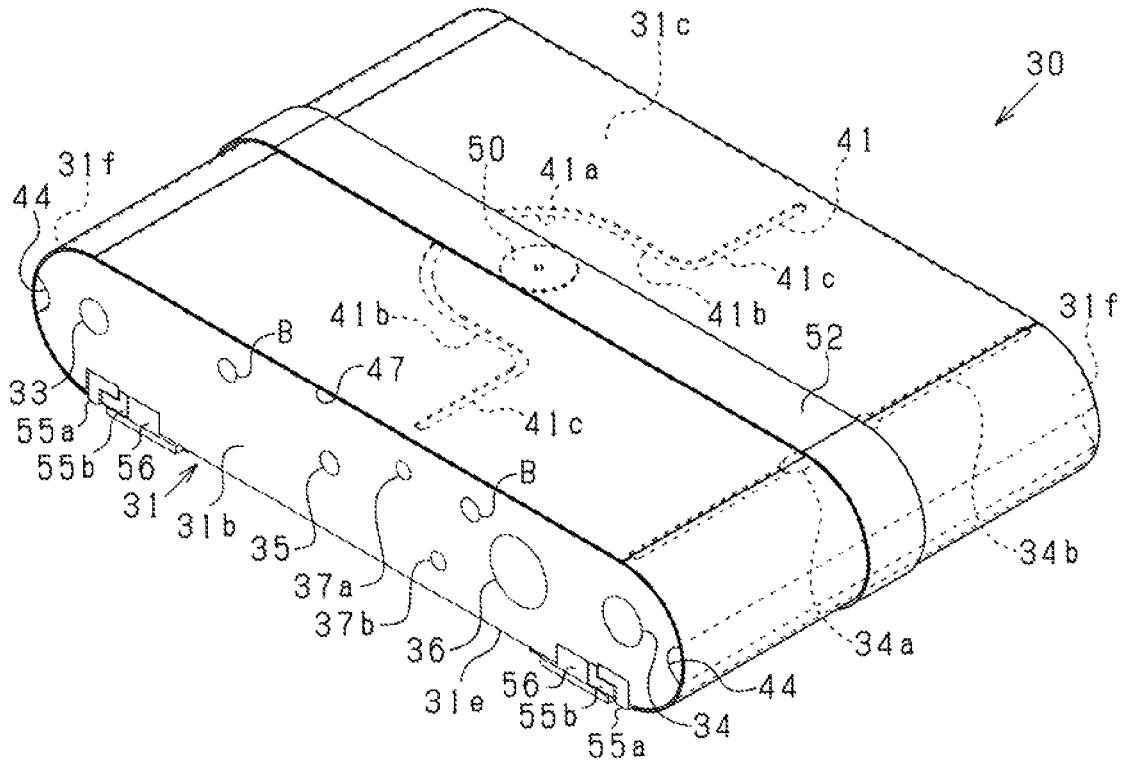
FIG. 3 is a perspective view showing a liquid control apparatus.
Figure 4:
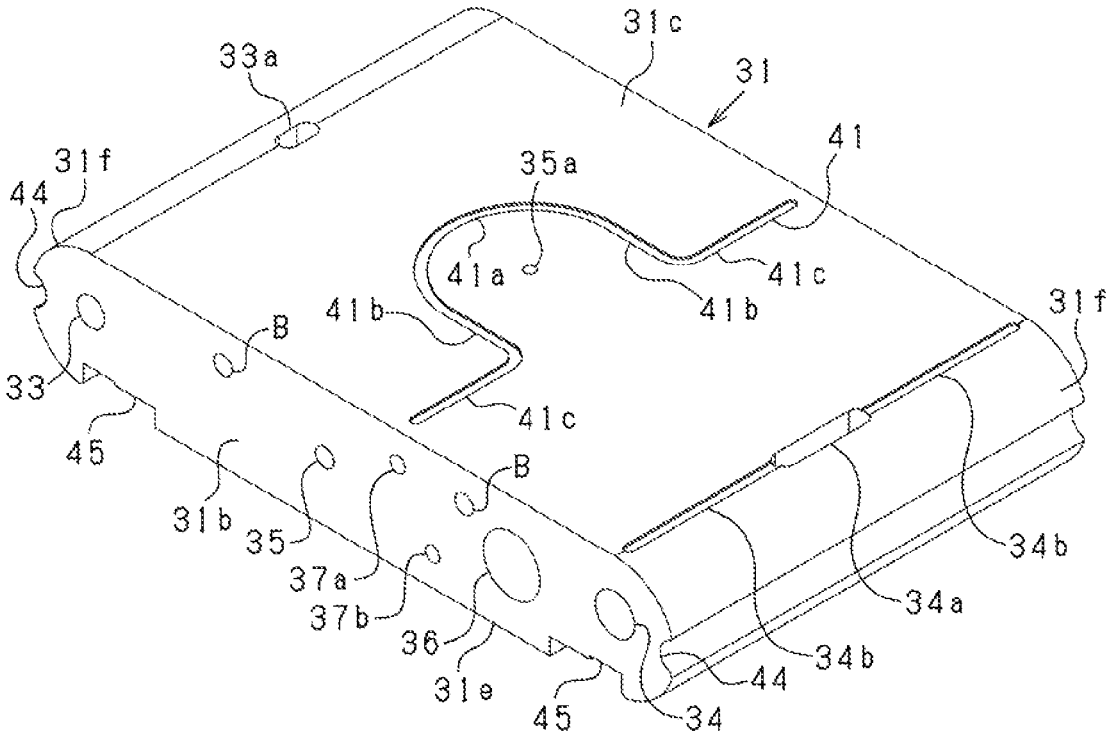
FIG. 4 is a perspective view showing a main body of the liquid control apparatus.

Next, a configuration of the liquid control apparatus 30 will be described in detail. FIG. 3 is a perspective view showing the liquid control apparatus 30, and FIG. 4 is a perspective view showing the main body 31 of the liquid control apparatus 30. As shown in the drawings, the liquid control apparatus 30 includes the main body 31, a mesh 47, a blocking member 50, a mesh band 52, mesh retainers 55*a* and 55*b*, and fixing members 56. The main body 31 is formed of a material exhibiting comparatively high corrosion resistance to chemicals and comparatively high chemical wettability. When the chemical is a hydrophobicity processing liquid, for example, the main body 31 is formed of a stainless steel material or an aluminum material.

The first main body flow passage 33 opens onto the upper surface 31*c* of the main body 31, and a gas introduction port 33*a* is formed in the upper surface 31*c*. The second main body flow passage 34 opens onto the upper surface 31*c* of the main body 31, and a gas discharge port 34*a* is formed in the upper surface 31*c*. Furthermore, the chemical flow passage 35 opens onto the upper surface 31*c* (a supply subject surface) of the main body 31, and a chemical supply port 35*a* is formed in the upper surface 31*c*.

The supply port 35*a*, the thermocouple insertion holes 37*a* and 37*b* (the thermocouples 83 and 84), and the heater insertion hole 36 (the heater 80) are provided between the introduction port 33*a* and the discharge port 34*a* in an expanse direction of the upper surface 31*c*. The supply port 35*a* is provided between the introduction port 33*a* and the discharge port 34*a* in the expanse direction of the upper surface 31*c*, or more specifically, between the introduction port 33*a* and the discharge port 34*a* but slightly closer to the introduction port 33*a*.

The supply port 35*a* is provided between the introduction port 33*a* and the thermocouple insertion holes 37*a* and 37*b* (a heater insertion hole 36) in the expanse direction of the upper surface 31*c*. In other words, the distance between the introduction port 33*a* and the supply port 35*a* is shorter than the distance between the introduction port 33*a* and the thermocouple insertions holes 37*a* and 37*b* in the lengthwise direction of the upper surface 31*c*.

The thermocouple insertion holes 37*a* and 37*b*, and the heater insertion hole 36 are provided between the supply port 35*a* and the discharge port 34*a* in the expanse direction of the upper surface 31*c*. In other words, the distance between the supply port 35*a* and the thermocouple insertion holes 37*a* and 37*b* (the heater insertion hole 36) is shorter than the distance between the supply port 35*a* and the discharge port 34*a* in the lengthwise direction of the upper surface 31*c*.

The thermocouple insertion holes 37*a* and 37*b* are provided in the main body 31 between the supply port 35*a* and the heater insertion hole 36 in the lengthwise direction of the upper surface 31*c*. The thermocouple insertion hole 37*a* is provided in the main body 31 between the supply port 35*a* and the thermocouple insertion hole 37*b* in the lengthwise direction of the upper surface 31*c*.

The discharge port 34*a* is formed to be larger than the introduction port 33*a*. More specifically, the discharge port 34*a* extends by a greater length than the introduction port 33*a* in a perpendicular direction (the widthwise direction of the upper surface 31*c*) to a direction extending from the introduction port 33*a* to the discharge port 34*a*.

A gas collecting groove 34*b* that communicates with the discharge port 34*a* is formed in the upper surface 31*c* of the main body 31. The gas collecting groove 34*b* extends in the widthwise direction of the upper surface 31*c* from respective ends of the discharge port 34*a*. The gas collecting groove 34*b* is provided over the entire length of the widthwise direction of the upper surface 31*c*. A width of the gas collecting groove 34*b* in a direction (the lengthwise direction of the upper surface 31*c*) extending from the introduction port 33*a* to the discharge port 34*a* is formed to be slightly narrower than a width of the discharge port 34*a*. A depth of the gas collecting groove 34*b* is set such that gas flowing in the direction from the introduction port 33*a* to the discharge port 34*a* can travel along the gas collecting groove 34*b* so as to be collected in the discharge port 34*a*. For example, the depth of the gas collecting groove 34*b* is set between 0.2 and 0.5 mm.

A suppression groove 41 (groove) for preventing the chemical from spreading from the supply port 35*a* to a side opposite to the heater insertion hole 36 (the heater 80) and a side opposite to the thermocouple insertion holes 37*a* and 37*b* (the thermocouples 83 and 84) is formed in the upper surface 31*c* of the main body 31 in the expanse direction (the lengthwise direction) of the upper surface 31*c*. The suppression groove 41 includes an arc part 41*a*, first rectilinear portions 41*b*, and second rectilinear portions 41*c*.

The arc part 41*a* is formed in the shape of a semicircular arc, and surrounds a periphery of the supply port 35*a* in the expanse direction of the upper surface 31*c* on sides excluding the sides of the heater insertion hole 36 and the thermocouple insertion holes 37*a* and 37*b*. In other words, the arc part 41*a* surrounds the half of the periphery of the supply port 35*a* on the side of an introduction port 33*a* (the half of the periphery on the side opposite to the discharge port 34*a*) in the expanse direction of the upper surface 31*c*.

The first rectilinear portions 41*b* extend in the expanse direction of the upper surface 31*c* from respective ends of the arc part 41*a* to the heater insertion hole 36 side. A length of the first rectilinear portions 41*b* is set to be substantially equal to a radius of the arc part 41*a*.

The second rectilinear portions 41*c* extend in the expanse direction of the upper surface 31*c* from end portions of the respective first rectilinear portions 41*b* to outer sides of the upper surface 31*c* in the widthwise direction of the upper surface 31*c*. A length of the second rectilinear portions 41*c* is set to be substantially equal to the length of the first rectilinear portions 41*b*. The second rectilinear portions 41*c* extend to end portions in the lengthwise direction of the upper surface 31*c*. A width of the suppression groove 41 is set between 0.75 and 50 mm, for example, and a depth of the suppression groove 41 is set between 0.2 and 0.5 mm, for example.

Engagement grooves 45 for engaging the mesh retainers 55*a* and 55*b*, and the fixing members 56 are formed in respective end portions in the lengthwise direction of the lower surface 31*e* of the main body 31. The engagement grooves 45 are formed to extend in a widthwise direction of the lower surface 31*e* at a predetermined width and a predetermined depth.

The mesh retainers 55*a* and 55*b* are formed in a rod shape having an "L" shaped cross-section. The fixing members 56 are formed in a rod shape having a "T" shaped cross-section. Lengths of the mesh retainers 55*a* and 55*b*, and the fixing members 56 are set to be equal to a widthwise direction length of the lower surface 31*e*.

The width and depth of the engagement groove 45 are set such that when the first mesh retainer 55*a*, the second mesh retainer 55*b*, and the fixing member 56 are attached in that order, these members are fixed. Note that the fixing member 56 may be a fastening member that fastens the second mesh retainer 55*b* to the main body 31.

Recessed portions 44 are formed in respective curved surfaces 31*f* of the main body 31 to extend rectilinearly in the widthwise direction of the upper surface 31*c*.

A mesh 47 (a mesh form body) woven into mesh form is provided around an outer periphery of the main body 31 so as to contact the upper surface 31*c* and the curved surfaces 31*f*.

The mesh 47 is formed in a rectangular shape that is large enough to cover the upper surface 31*c* and the curved surfaces 31*f*. More specifically, the widthwise direction length of the upper surface 31*c* matches a widthwise direction length of the mesh 47, while a lengthwise direction length of the mesh 47 is greater than a combined length of the lengthwise direction length of the upper surface 31*c* and respective lengths of the outer peripheries of the curved surfaces 31*f*.

The mesh 47 is wrapped around the upper surface 31*c* and the two curved surfaces 31*f*. As a result, the introduction port 33*a*, the supply port 35*a*, the suppression groove 41, the gas collecting groove 34*b*, and the discharge port 34*a* are covered by the mesh 47.

A mesh size of the mesh 47 is set at a size enabling the chemical to form a film easily in the openings of the mesh 47. For example, 100 mesh having 100 openings per inch is used. More specifically, in the mesh 47, a wire diameter is set at 0.1 mm and an inter-wire distance is set at 0.15 mm. The size of the mesh 47 is preferably set appropriately in accordance with the chemical wettability of the mesh 47, the chemical wettability of the main body 31, the viscosity of the chemical, and so on. Here, the width of the suppression groove 41 is set to be at least five times the inter-wire distance of the mesh 47, while the depth of the suppression groove 41 is set to be at least twice the wire diameter of the mesh 47. The mesh 47 is formed of a material exhibiting comparatively high corrosion resistance to chemicals and comparatively high chemical wettability. When the chemical is a hydrophobicity processing liquid, for example, the mesh 47 is formed of a stainless steel material.

The blocking member 50 is provided in a position corresponding to the supply port 35*a* so as to cover the supply port 35*a*. More specifically, the blocking member 50 (blocking member, guiding member) covers only the supply port 35*a* and the vicinity thereof, and is surrounded by the arc part 41*a* and the first rectilinear portions 41*b* of the suppression groove 41. The blocking member 50 is provided on an outer side of the mesh 47 so as to contact the mesh 47. In other words, the blocking member 50 contacts the mesh 47 on a side opposite to the main body 31 side such that the mesh 47 is sandwiched between the upper surface 31*c* of the main body 31 and the blocking member 50.

Hence, the blocking member 50 does not contact the upper surface 31*c* of the main body 31, and therefore a chemical flow passage is secured by the mesh 47 between the upper surface 31*c* and the blocking member 50. The blocking member 50 is also formed of a material that exhibits comparatively high corrosion resistance to chemicals and comparatively high chemical wettability.

The mesh band 52, which is woven into mesh form, is provided around the outer periphery of the main body 31 (the mesh 47) so as to extend in the direction from the introduction port 33*a* to the discharge port 34*a* (the lengthwise direction of the upper surface 31*c*).

The mesh band 52 (guiding member) covers the introduction port 33*a*, the supply port 35*a* (the blocking member 50), and the discharge port 34*a*. In other words, the mesh band 52 extends in the expanse direction of the upper surface 31*c* from the introduction port 33*a* toward the supply port 35*a*, the thermocouple insertion holes 37*a* and 37*b* (the thermocouples 83, 84), the heater insertion hole 24 (the heater 80), and the discharge port 34*a*, in that order.

The mesh band 52 is provided on the outer side of the mesh 47 and the blocking member 50 so as to contact the mesh 47 and the blocking member 50. In other words, the mesh band 52 contacts the mesh 47 on the side opposite to the main body 31 side such that the mesh 47 is sandwiched between the upper surface 31*c* of the main body 31 and the mesh band 52. Further, the blocking member 50 is sandwiched between the mesh 47 and the mesh band 52.

The mesh band 52 is formed in a rectangular shape (a strip shape) that is large enough to cover the introduction port 33*a* and the blocking member 50 (the supply port 35*a*). More specifically, a diameter of the blocking member 50 and a widthwise direction length of the mesh band 52 are substantially equal, while a widthwise direction length of the mesh band 52 is shorter than an interval between the two first rectilinear portions 41*b* of the suppression groove 41. A lengthwise direction length of the mesh band 52 is greater than the combined length of the lengthwise direction length of the upper surface 31*c* and the respective lengths of the outer peripheries of the curved surfaces 31*f*.

The mesh band 52 is wrapped around the upper surface 31*c* and the two curved surfaces 31*f*. A mesh size of the mesh band 52 is likewise set at a size enabling the chemical to form a film easily in the openings of the mesh band 52. For example, 100 mesh having 100 openings per inch is used. The mesh band 52 is also formed of a material exhibiting comparatively high corrosion resistance to chemicals and comparatively high chemical wettability.

Respective lengthwise direction ends of the mesh 47 and the mesh band 52 are fixed by the respective mesh retainers 55*a* and 55*b*, and the fixing members 56. More specifically, in the engagement grooves 45, the end portions of the mesh 47 and the mesh band 52 are retained by the first mesh retainers 55*a*, while the first mesh retainers 55*a* are retained by the second mesh retainers 55*b*.

The end portions of the mesh 47 and the mesh band 52 are led to the outside from between the first mesh retainers 55*a* and the second mesh retainers 55*b*. In other words, the end portions of the mesh 47 and the mesh band 52 are respectively sandwiched between the first mesh retainers 55*a* and the second mesh retainers 55*b*.

Then, in a state where the second mesh retainers 55*b* are respectively retained by the fixing members 56, the fixing members 56 are engaged to the respective engagement grooves 45. As a result, the mesh retainers 55*a* and 55*b*, and the fixing members 56 are engaged to the engagement grooves 45 fixedly. Although not shown in the drawings, when the fixing member 56 is constituted by a screw, the second mesh retainer 55*b* is fastened to the main body 31 by the screw.

Here, the mesh 47 and the mesh band 52 are fixed while being stretched in the respective lengthwise directions thereof. Therefore, the mesh 47 contacts the upper surface 31*c* and the curved surfaces 31*f* of the main body 31 closely, and the mesh band 52 contacts the mesh 47 closely. Further, the blocking member 50 is in a state of close contact with the mesh 47 and the mesh band 52.

Figure 5:
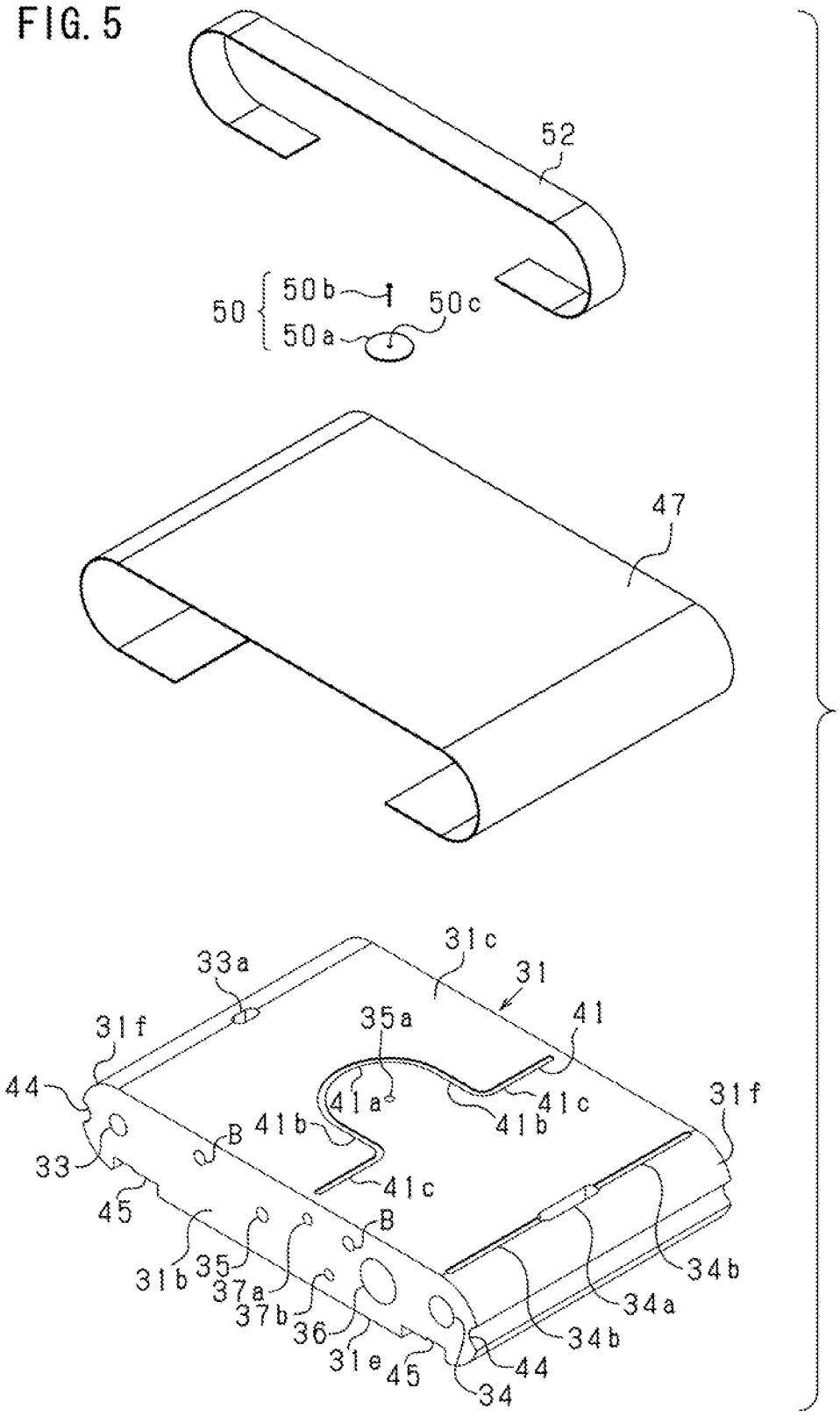
FIG. 5 is an exploded perspective view of the liquid control apparatus.

Next, procedures for assembling the liquid control apparatus 30 will be described. FIG. 5 is an exploded perspective view of the liquid control apparatus 30. As shown in the drawing, the blocking member 50 includes a disc-shaped disc portion 50*a* and a needle-shaped pin 50*b*. A through hole 50*c* is formed in a center of the disc portion 50*a* (a first part). One end of the pin 50*b* (a second part) forms a sharp end portion sharpened into a needle shape, while the other end forms a head portion having a larger diameter than a remaining part. A diameter of the head portion of the pin 50*b* is larger than a diameter of the through hole 50*c*, whereas a diameter of the part of the pin 50*b* other than the head portion is smaller than the diameter of the through hole 50*c*. A diameter of the sharp end portion of the pin 50*b* is smaller than the inter-wire distance, i.e. 0.15 mm, of the mesh 47.

First, the mesh 47 is wrapped around the outer periphery of the main body 31 such that the lengthwise direction of the mesh 47 is aligned with the lengthwise direction of the upper surface 31*c* of the main body 31. At this time, the mesh 47 covers the entirety of the upper surface 31*c* and the curved surfaces 31*f* with surplus at either end.

Next, the disc portion 50*a* of the blocking member 50 is disposed to cover the supply port 35*a* from the outer side of the mesh 47. At this time, a center position of the supply port 35*a* is aligned with a center position (the position of the through hole 50*c*) of the disc portion 50*a*. The pin 50*b* is then inserted into the through hole 50*c* in the disc portion 50*a* from the sharp end portion and inserted into the supply port 35*a* through the mesh 47. The diameter of the sharp end portion of the pin 50*b* is smaller than the inter-wire distance of the mesh 47, and therefore the sharp end portion can be inserted between adjacent wires of the mesh 47. The head portion of the pin 50*b* is then brought into contact with the disc portion 50*a*, whereby insertion of the pin 50*b* is complete.

Next, the mesh band 52 is wrapped around the outer periphery of the main body 31 such that the lengthwise direction of the mesh band 52 is aligned with the lengthwise direction of the upper surface 31*c* of the main body 31. More specifically, the mesh band 52 is wrapped so as to overlap the introduction port 33*a*, the supply port 35*a* (the blocking member 50), and the discharge port 34*a*. At this time, the mesh band 52 covers the upper surface 31*c* and the curved surfaces 31*f* with surplus at either end.

Next, as shown in FIGS. 2B, 2C, and 3, the respective end portions of the mesh 47 and the mesh band 52 are initially retained in the engagement grooves 45 by the first mesh retainers 55*a*. In this state, or in a state where the first mesh retainers 55*a* are retained by the second mesh retainers 55*b*, the mesh 47 and the mesh band 52 are stretched in the respective lengthwise directions thereof. As a result, wrinkles in the mesh 47 and the mesh band 52 are stretched and tension is generated in the mesh 47 and the mesh band 52. The mesh retainers 55*a* and 55*b* are then fixed by the fixing members 56, whereby assembly of the liquid control apparatus 30 is complete.

As described above, the liquid control apparatus 30 thus assembled is attached to the side face 20*b* of the second housing 20 using a fastening member in the through hole B formed in the main body 31. As a result, a gap having an oval tubular shape is formed between the inner peripheral surface of the first housing 11 and the main body 31.

When the mesh 47 and the mesh band 52 are wrapped around the outer periphery of the main body 31 and fixed, gaps are formed between the mesh 47 (mesh band 52) and the recessed portions 44 in the curved surfaces 31*f*. Hence, insertion members 57 are inserted between the main body 31 and the mesh 47 (mesh band 52) along an axial direction of the main body 31 (the widthwise direction of the upper surface 31*c*) so as to engage with the recessed portions 44.

The insertion member 57 is formed in a round bar shape, and a radius of a cross-section of the round bar is set to be substantially equal to a radius of curvature of the recessed portion 44. A tip end portion of the insertion member 57 is formed to be slightly narrower than a remaining part, and the insertion member 57 is inserted from the tip end portion while pressing the mesh 47 and the mesh band 52 into the recessed portion 44. Accordingly, the gap between the recessed portion 44 and the mesh 47 (mesh band 52) is reduced, enabling an increase in the tension generated in the mesh 47 and the mesh band 52. As a result, the mesh 47 and the mesh band 52 are forcefully brought into close contact with the main body 31.

Figure 6:
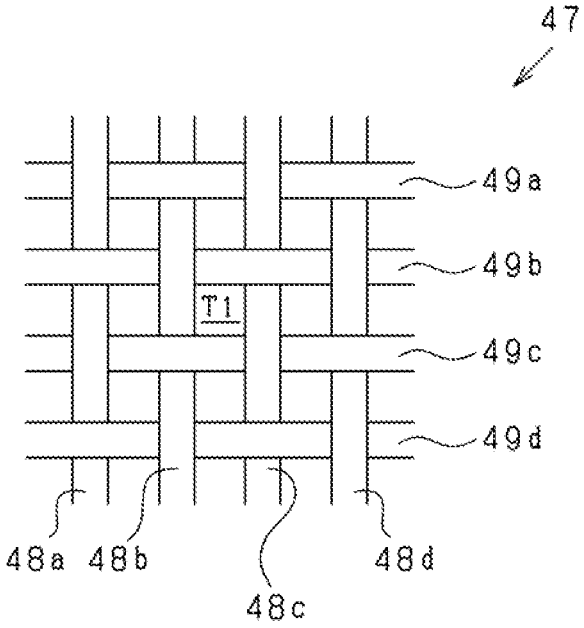
FIG. 6 is an enlarged plan view of a mesh.

Next, a principle by which the chemical contacting the upper surface 31*c* of the main body 31 is caused to spread by the mesh 47, the mesh band 52, and the blocking member 50 will be described. FIG. 6 is an enlarged plan view of the mesh 47. The mesh 47 is formed by knitting (weaving) vertical wires 48*a*, 48*b*, 48*c* and 48*d*, and horizontal wires 49*a*, 49*b*, 49*c* and 49*d* into mesh form.

Mesh spaces surrounded by the vertical wires and the horizontal wires when seen from above are formed in the mesh 47. The mesh spaces take the shape of a rectangular parallelepiped (a square shape when seen from above), and are formed at equal intervals in a vertical direction and a horizontal direction of the mesh 47. For example, a mesh space T1 is a minute space (0.15 mm×0.15 mm×the thickness of the mesh 47) surrounded by the two vertical wires 48*b* and 48*c*, and the two horizontal wires 49*b* and 49*c*.

Since the mesh space T1 is a minute space, a comparatively large intermolecular force acts between the wires 48*b*, 48*c*, 49*b* and 49*c*, and the chemical. As a result, the chemical is suctioned into the mesh space T1, whereby a chemical film is formed so as to close the mesh space T1 (a capillary action). In this condition, the chemical is suctioned into each mesh space, and therefore an action by which the chemical attempts to spread over the surface of the mesh 47 is comparatively small.

Figure 7:
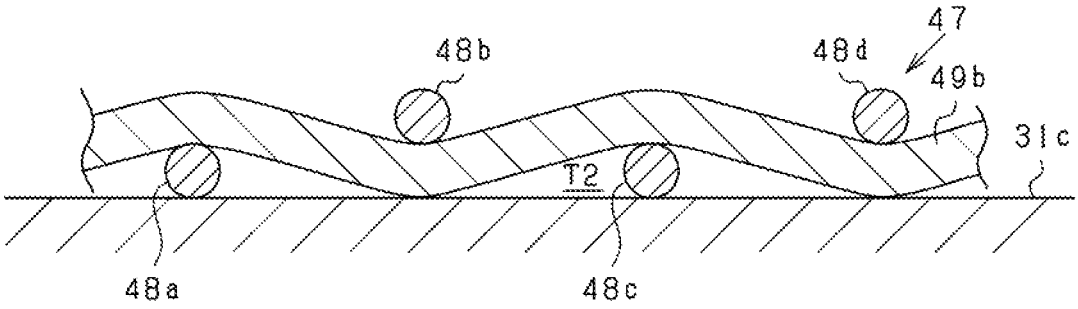
FIG. 7 is an enlarged sectional view showing an upper surface of the main body and the mesh.

FIG. 7 is an enlarged sectional view showing the upper surface 31*c* of the main body 31 and the mesh 47. As shown in the drawing, a flow space T2 surrounded by the upper surface 31*c* of the main body 31, the vertical wire, and the horizontal wire when seen from the side is formed between the upper surface 31*c* and the mesh 47. The flow space T2 connects gaps between the upper surface 31*c* and the vertical and horizontal wires, and is formed to extend along the upper surface 31*c*.

In parts where the vertical wires 48*a*, 48*b*, 48*c* and 48*d* contact the upper surface 31*c* (intersecting parts between the wires), the horizontal wires 49*a*, 49*b*, 49*c* and 49*d* are separated from the upper surface 31*c*. In parts where the horizontal wires 49*a*, 49*b*, 49*c* and 49*d* contact the upper surface 31*c* (intersecting parts between the wires), on the other hand, the vertical wires 48*a*, 48*b*, 48*c* and 48*d* are separated from the upper surface 31*c*. Hence, the flow space T2 extends continuously along the upper surface 31*c* without being blocked by the vertical wires and horizontal wires.

A large number of minute interfaces are formed between the upper surface 31*c* and the vertical and horizontal wires. Therefore, the chemical supplied to the upper surface 31*c* is caused to spread over the upper surface 31*c* through the flow space T2 by interfacial tension in the large number of minute interfaces (a capillary action). Further, the chemical possesses wettability relative to the upper surface 31*c*, the vertical wires, and the horizontal wires, and therefore spreading of the chemical over the upper surface 31*c* is promoted.

Figure 8:
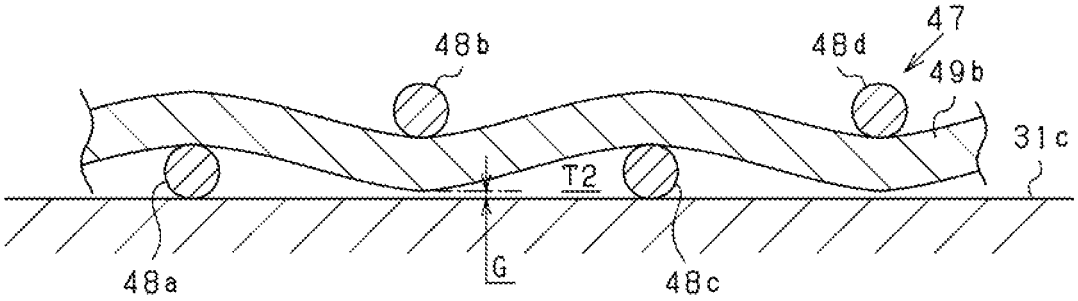
FIG. 8 is an enlarged sectional view showing the upper surface of the main body and the mesh.

FIG. 8 is an enlarged sectional view showing the upper surface 31*c* of the main body 31 and the mesh 47. Here, a condition in which a part of the horizontal wire 49*b* is separated from the upper surface 31*c* to form a gap G is shown. Likewise in this condition, the chemical is caused to spread through the flow space T2 by interfacial tension. In other words, the vertical wires and the horizontal wires may be partially separated from the upper surface 31*c*.

Figure 9:
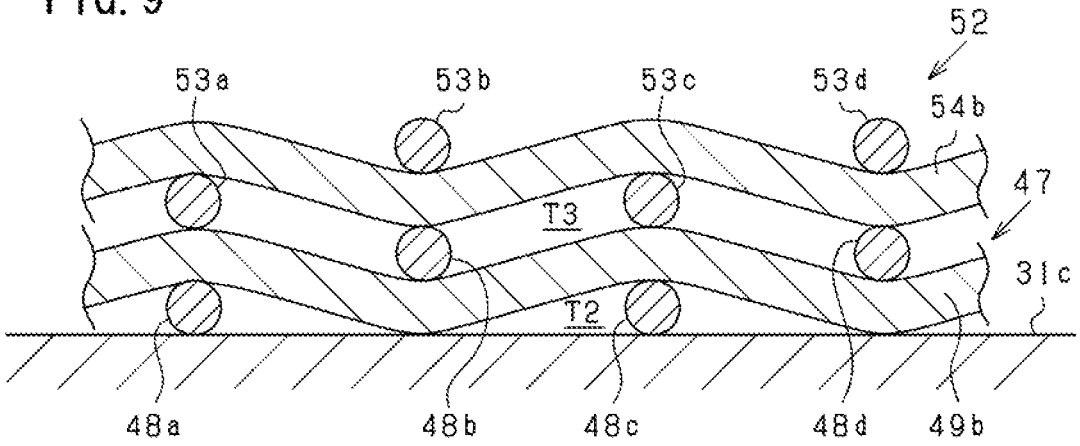
FIG. 9 is an enlarged sectional view showing the upper surface of the main body, the mesh, and a mesh band.

FIG. 9 is an enlarged sectional view showing the upper surface 31*c* of the main body 31, the mesh 47, and the mesh band 52. As shown in the drawing, in addition to the flow space T2, a flow space T3 surrounded by the vertical wires and horizontal wires of the mesh 47 and the vertical wires and horizontal wires of the mesh band 52 when seen from the side is formed between the mesh 47 and the mesh band 52. The flow space T3 connects gaps between the vertical wires and horizontal wires of the mesh 47 and the vertical wires and horizontal wires of the mesh band 52, and extends substantially parallel to the upper surface 31*c*.

In parts where vertical wires 53*a*, 53*b*, 53*c* and 53*d* of the mesh band 52 contact the horizontal wires of the mesh 47 (intersecting parts between the wires), horizontal wires of the mesh band 52 are separated from the horizontal wires of the mesh 47. In parts where the horizontal wires of the mesh band 52 contact the vertical wires of the mesh 47 (intersecting parts between the wires), on the other hand, vertical wires 53*a*, 53*b*, 53*c* and 53*d* of the mesh band 52 are separated from the vertical wires of the mesh 47. Hence, the flow space T3 extends continuously substantially parallel to the upper surface 31*c* without being blocked by the vertical wires and horizontal wires.

A large number of minute interfaces are formed between the vertical and horizontal wires of the mesh 47 and the vertical and horizontal wires of the mesh band 52. Therefore, the chemical supplied to the upper surface 31*c* is caused to spread over the upper surface 31*c* through the flow space T2 and caused to spread substantially parallel to the upper surface 31*c* through the flow space T3 by interfacial tension between the large number of minute interfaces (a capillary action). Further, the chemical possesses wettability relative to the upper surface 31*c*, the vertical wires and horizontal wires of the mesh 47, and the vertical wires and horizontal wires of the mesh band 52, and therefore spreading of the chemical is promoted. Note that in the drawing, positions of the vertical wires of the mesh 47 and the vertical wires of the mesh band 52 and positions of the horizontal wires of the mesh 47 and the horizontal wires of the mesh band 52 are shown to be aligned, but these positions may deviate from each other.

Figure 10:
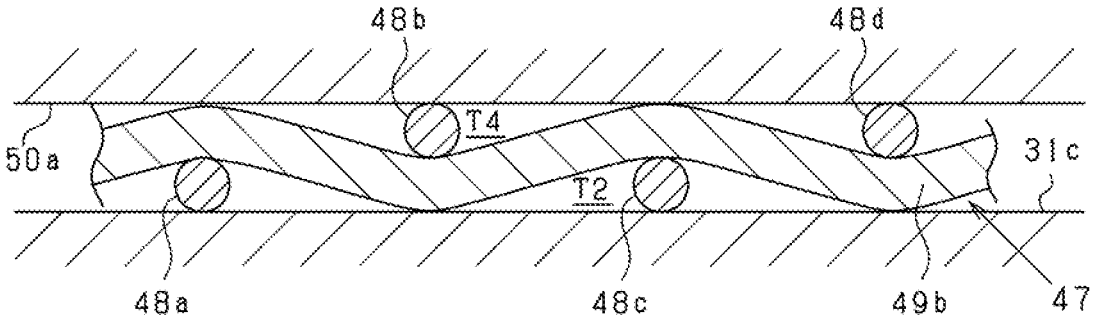
FIG. 10 is an enlarged sectional view showing the upper surface of the main body, the mesh, and a blocking member.

FIG. 10 is an enlarged sectional view showing the upper surface 31*c* of the main body 31, the mesh 47, and the blocking member 50. As shown in the drawing, in addition to the flow space T2, a flow space T4 surrounded by the disc portion 50*a* of the blocking member 50 and the vertical wires and horizontal wires when seen from the side is formed between the disc portion 50*a* and the mesh 47. The flow space T4 is formed similarly to the flow space T2 as a space which connects gaps between a lower surface of the disc portion 50*a* and the vertical and horizontal wires so as to extend along the lower surface of the disc portion 50*a*.

Hence, the chemical supplied to the upper surface 31*c* is caused to spread over the upper surface 31*c* through the flow space T2 and caused to spread over the lower surface of the disc portion 50*a* through the flow space T4 by interfacial tension between the large number of minute interfaces (a capillary action). Further, the chemical possesses wettability relative to the upper surface 31*c*, the lower surface of the disc portion 50*a*, and the vertical wires and horizontal wires, and therefore spreading of the chemical is promoted.

Next, referring to FIGS. 1A, 1B and 3, an action of the liquid vaporizer 10 will be described. Here, a case in which the chemical (a hydrophobicity processing liquid, for example) vaporized by the liquid control apparatus 30 is mixed with an inert gas (nitrogen, for example) before being supplied to a following apparatus will be described as an example.

When the inert gas is introduced from the first gas pipe 26*b*, the inert gas is introduced into the columnar space S in the first housing 11 from the introduction port 33*a* in the main body 31 through the first gas flow passage 21 and the first main body flow passage 33. The inert gas flows through a gap formed between the inner peripheral surface of the first housing 11 and the main body 31 of the liquid control apparatus 30, intermixes with the hydrophobicity processing liquid vaporized by the liquid control apparatus 30, and then flows into the discharge port 34*a*. The mixed gas flowing into the discharge port 34*a* is discharged from the second gas pipe 27*b* via the second main body flow passage 34 and the second gas flow passage 22. The second gas pipe 27*b* is connected to the following apparatus, and therefore the mixed gas discharged from the second gas pipe 27*b* is supplied to the following apparatus.

When the chemical is supplied from the chemical pipe 28*b*, the chemical is supplied to the upper surface 31*c* from the supply port 35*a* in the main body 31 through the chemical flow passages 23 and 35. At this time, the chemical supplied from the supply port 35*a* impinges on the blocking member 50 covering the supply port 35*a*, and therefore spurting of the chemical through the mesh 47 and the mesh band 52 is suppressed. Further, the pin 50*b* of the blocking member 50 is inserted into the supply port 35*a*, and therefore the blocking member 50 is prevented from deviating from the supply port 35*a* even when a pressure of the chemical acts on the blocking member 50. The pin 50*b* can also be used to position the blocking member 50 relative to the supply port 35*a*.

As shown in FIG. 10, between the upper surface 31*c* of the main body 31 and the disc portion 50*a* of the blocking member 50, the supplied chemical is caused to spread over the upper surface 31*c* through the flow space T2 and caused to spread over the lower surface of the disc portion 50*a* through the flow space T4 by the interfacial tension between the large number of minute interfaces. Hence, the chemical spreads more quickly in this part than in the part where only the mesh 47 is provided on the upper surface 31*c*.

The chemical spreads further toward the periphery under the disc portion 50*a* of the blocking member 50. In the part where only the mesh 47 is provided on the upper surface 31*c*, as shown in FIG. 7, the chemical is caused to spread over the upper surface 31*c* through the flow space T2 by the interfacial tension between the large number of minute interfaces. In the part where the mesh 47 and the mesh band 52 are provided on the upper surface 31*c*, meanwhile, as shown in FIG. 9, the chemical is caused to spread over the upper surface 31*c* through the flow space T2 and caused to spread substantially parallel to the upper surface 31*c* through the flow space T3 by the interfacial tension between the large number of minute interfaces. Hence, the chemical that flows under the disc portion 50*a* of the blocking member 50 spreads preferentially along the mesh band 52.

Further, the part of the chemical that spreads to the periphery of the blocking member 50 along the upper surface 31*c* reaches the suppression groove 41 in the upper surface 31*c*. In the part where the suppression groove 41 is formed, no interfaces are formed between the upper surface 31*c* and the mesh 47, and therefore spreading of the chemical is suppressed. Here, the arc part 41*a* of the suppression groove 41 surrounds the periphery of the supply port 35*a* in the expanse direction of the upper surface 31*c* on sides excluding the sides of the heater insertion hole 36 (the heater 80) and the thermocouple insertion holes 37*a* and 37*b* (the thermocouples 83 and 84). Therefore, spreading of the chemical in directions other than the sides of the heater 80, and the thermocouples 83 and 84 is suppressed. As a result, an amount of the chemical that flows to the sides of the heater 80, and the thermocouples 83 and 84 in the expanse direction of the upper surface 31*c* is increased such that spreading of the chemical to the sides of the heater 80, and the thermocouples 83 and 84 is promoted. Spreading of the chemical to the sides of the heater 80, and the thermocouples 83 and 84 in the expanse direction of the upper surface 31*c* is also promoted by the first rectilinear portions 41*b* and second rectilinear portions 41*c* of the suppression groove 41.

The heater 80 is inserted into the heater insertion hole 36, and the upper surface 31*c* of the main body 31 is heated by the heater 80. Here, spreading of the chemical to the heater 80 side in the expanse direction of the upper surface 31*c* is promoted by the mesh band 52 and the suppression groove 41, and therefore the efficiency with which the chemical is heated by the heater 80 can be improved. Further, the mesh band 52 is formed by being woven into mesh form, and therefore evaporation of the chemical via the mesh band 52 is promoted in comparison with a case in which the mesh band 52 is formed in plate form or film form. Hence, with the mesh band 52, spreading of the chemical to the heater 80 side can be promoted while ensuring that the chemical evaporates favorably.

When the chemical supplied to the upper surface 31*c* evaporates, the temperature of the upper surface 31*c* is reduced by resulting vaporization heat. Therefore, by detecting the temperature in the vicinity of the upper surface 31*c* using the first thermocouple 83, a degree of vaporization of the chemical can be calculated. Here, spreading of the chemical to the first thermocouple 83 side in the lengthwise direction of the upper surface 31*c* is promoted by the mesh band 52 and the suppression groove 41, and therefore the temperature reduction on the upper surface 31*c* due to vaporization of the chemical is reflected with great sensitivity in a detection value of the first thermocouple 83. Accordingly, the precision with which the degree of vaporization of the chemical is calculated can be improved. Note that the temperature of a position close to the lower surface 31*e* of the main body 31 can be detected using the second thermocouple 84, and a resulting detection value can be used to control heating of the upper surface 31*c* by the heater 80.

Further, the inert gas introduced from the introduction port 33*a* travels over the supply port 35*a*, the first thermocouple 83, and the heater 80 in that order, and is then discharged from the discharge port 34*a*. Therefore, spreading of the chemical from the supply port 35*a* to the sides of the heater 80 and the thermocouples 83 and 84 can also be promoted by the inert gas.

The embodiment described in detail above has the following advantages.

The mesh 47 is woven into mesh form and provided to contact the upper surface 31*c* of the main body 31, and therefore a plurality of interfaces are formed between the upper surface 31*c* and the mesh 47. Therefore, the chemical supplied to the upper surface 31*c* is caused to spread over the upper surface 31*c* by the interfacial tension between the plurality of interfaces.

Here, the mesh band 52 is provided to contact the mesh 47 on the side opposite to the main body 31, and therefore a plurality of interfaces are also formed between the mesh 47 and the mesh band 52. Hence, the chemical can also be caused to spread between the mesh 47 and the mesh band 52 by interfacial tension. Hence, spreading of the chemical can be promoted in the part provided with the mesh band 52 over other parts. As a result, by adjusting the arrangement of the mesh band 52, the chemical contacting the upper surface 31*c* can be caused to spread preferentially in a desired direction.

The mesh band 52 is formed by being woven into mesh form, and therefore evaporation of the chemical via the mesh band 52 can be promoted in comparison with a case where the mesh band 52 is formed in plate form or film form.

The mesh 47 and the mesh band 52 are provided to cover the supply port 35*a*, and therefore the chemical supplied from the supply port 35*a* is immediately caused to spread preferentially over the mesh band 52. Hence, the chemical supplied from the supply port 35*a* can be caused to spread in the desired direction efficiently.

The disc portion 50*a* of the blocking member 50 formed in plate form is provided to cover the supply port 35*a*. Therefore, the chemical supplied from the supply port 35*a* can be prevented from spurting through the mesh 47 and the mesh band 52.

Only the supply port 35*a* and the vicinity thereof are covered by the blocking member 50, and therefore a situation in which evaporation of the chemical is impaired by the blocking member 50 can be prevented from occurring while suppressing spurting of the chemical supplied from the supply port 35*a*.

The pin 50*b* that projects from the disc portion 50*a* of the blocking member 50 is inserted into the supply port 35*a*, and therefore the blocking member 50 can be prevented from deviating from the supply port 35*a* even when the pressure of the chemical acts on the blocking member 50. Furthermore, the pin 50*b* can be used to position the blocking member 50 relative to the supply port 35*a*.

The mesh band 52 extends from the supply port 35*a* toward the heater 80 in the expanse direction of the upper surface 31*c*, and therefore the chemical supplied from the supply port 35*a* can be caused to spread preferentially in the direction of the heater 80. As a result, the chemical can be heated efficiently by the heater 80.

Spreading of the chemical from the supply port 35*a* to the side opposite to the heater 80 in the expanse direction of the upper surface 31*c* is suppressed by the suppression groove 41 provided in the upper surface 31*c*. By suppressing spreading of the chemical to the side opposite to the heater 80 in the expanse direction of the upper surface 31*c*, spreading of the chemical to the side of the heater 80 can be promoted. As a result, heating of the chemical by the heater 80 can be promoted. Moreover, the arc part 41*a* of the suppression groove 41 surrounds the periphery of the supply port 35*a* in the expanse direction of the upper surface 31*c* on sides excluding the side of the heater 80, and therefore spreading of the chemical in directions other than the side of the heater 80 is suppressed. As a result, spreading of the chemical to the side of the heater 80 can be further promoted.

Inert gas is introduced from the interior of the main body 31 into the columnar space S on the periphery of the upper surface 31*c* through the introduction port 33*a*, and the inert gas is discharged from the columnar space S into the interior of the main body 31 through the discharge port 34*a*. At this time, spreading of the chemical contacting the upper surface 31*c* in a flow direction of the inert gas is promoted. Further, the inert gas introduction port 33*a* and discharge port 34*a* are provided on either side of the heater 80 in the expanse direction of the upper surface 31*c*, and therefore spreading of the chemical in a direction passing through the heater 80 can be promoted. As a result, heating of the chemical by the heater 80 can be promoted.

The supply port 35*a* is provided in the main body 31 between the inert gas introduction port 33*a* and the heater 80 in the lengthwise direction of the upper surface 31*c*, and therefore spreading of the chemical to the side of the heater 80 is promoted by the flow of the inert gas from the introduction port 33*a* to the discharge port 34*a*. Hence, the chemical supplied from the supply port 35*a* can be caused to spread efficiently to the side of the heater 80 in the lengthwise direction of the upper surface 31*c*.

The mesh band 52 extends toward the thermocouples 83 and 84 in the expanse direction of the upper surface 31*c*, and therefore the chemical contacting the upper surface 31*c* can be caused to spread preferentially in the direction of the thermocouples 83 and 84. As a result, the temperature reduction on the upper surface 31*c* due to vaporization of the chemical is reflected with great sensitivity in the detection value of the thermocouples 83 and 84, and therefore the precision with which the degree of vaporization of the chemical is calculated can be improved. Furthermore, the mesh band 52 extends toward the thermocouples 83 and 84 from the supply port 35*a* in the expanse direction of the upper surface 31*c*, and therefore the chemical supplied from the supply port 35*a* can be caused to spread preferentially in the direction of the thermocouples 83 and 84. As a result, the chemical spreads from the supply port 35*a* in the direction of the thermocouples 83 and 84 with stability, and therefore the temperature reduction on the upper surface 31*c* due to vaporization of the chemical can be stabilized.

Spreading of the chemical from the supply port 35*a* to the side opposite to the thermocouples 83 and 84 in the expanse direction of the upper surface 31*c* is suppressed by the suppression groove 41 provided in the upper surface 31*c*. By suppressing spreading of the chemical to the side opposite to the thermocouples 83 and 84 in the expanse direction of the upper surface 31*c*, spreading of the chemical to the side of the thermocouples 83 and 84 can be promoted. As a result, the precision with which the degree of vaporization of the chemical is calculated can be improved. Moreover, the arc part 41*a* of the suppression groove 41 surrounds the periphery of the supply port 35*a* in the expanse direction of the upper surface 31*c* on sides excluding the side of the thermocouples 83 and 84, and therefore spreading of the chemical in directions other than the side of the thermocouples 83 and 84 is suppressed. As a result, spreading of the chemical to the side of the thermocouples 83 and 84 in the expanse direction of the upper surface 31*c* can be further promoted.

The inert gas is introduced into the columnar space S on the periphery of the upper surface 31*c* from the interior of the main body 31 through the introduction port 33*a*, and discharged to the interior of the main body 31 from the columnar space S through the discharge port 34*a*. At this time, spreading of the chemical contacting the upper surface 31*c* in the flow direction of the inert gas is promoted. Further, the thermocouples 83 and 84 are provided between the inert gas introduction port 33*a* and discharge port 34*a* in the expanse direction of the upper surface 31*c*, and therefore spreading of the chemical in a direction passing through the thermocouples 83 and 84 can be promoted. As a result, the precision with which the degree of vaporization of the chemical is calculated can be improved.

The supply port 35*a* is provided in the main body 31 between the inert gas introduction port 33*a* and the thermocouples 83 and 84 in the lengthwise direction of the upper surface 31*c*, and therefore spreading of the chemical to the side of the thermocouples 83 and 84 is promoted by the flow of the inert gas from the introduction port 33*a* to the discharge port 34*a*. As a result, the chemical supplied from the supply port 35*a* can be caused to spread efficiently to the side of the thermocouples 83 and 84 in the expanse direction of the upper surface 31*c*.

Note that the embodiment described above may be implemented after being modified as follows. Identical members to the above embodiment have been allocated identical reference symbols, and description thereof has been omitted.

Figure 11:
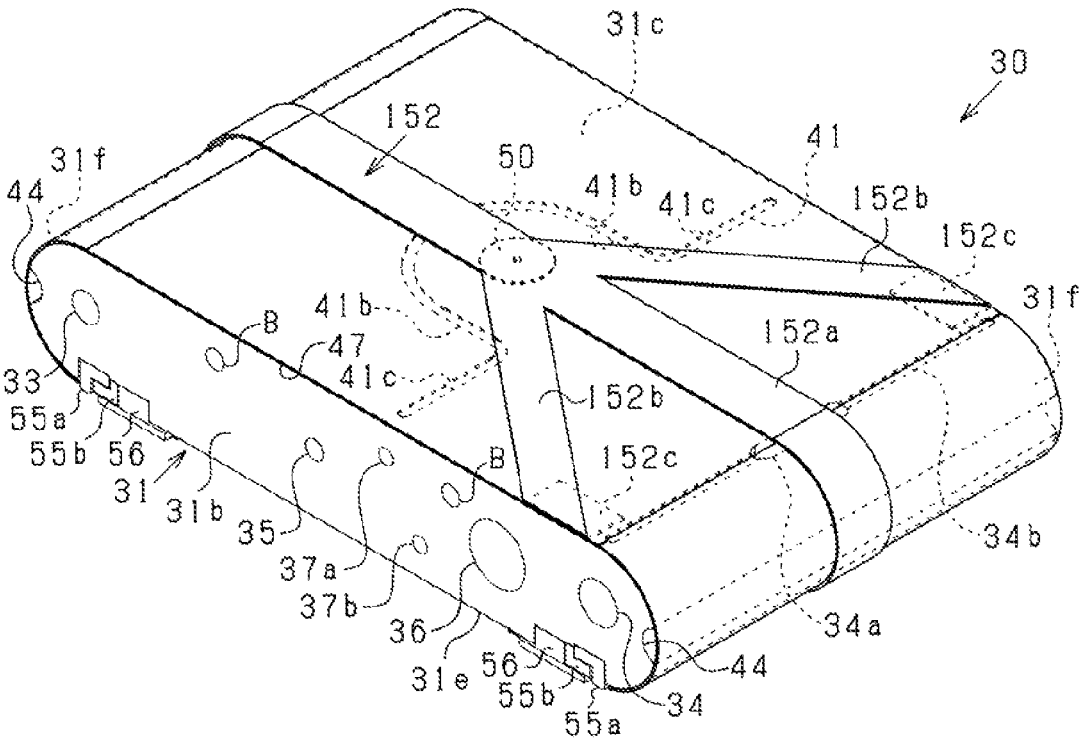
FIG. 11 is a perspective view showing a modified example of the mesh band.

FIG. 11 is a perspective view showing a modified example of the mesh band 52. As shown in the drawing, a mesh band 152 includes a main body portion 152*a* corresponding to the mesh band 52 shown in FIG. 3, branch portions 152*b* branching from the main body portion 152*a*, and end portions 152*c*. The branch portions 152*b* branch diagonally in the direction of the heater insertion hole 36 (the heater 80) from a position of the main body portion 152*a* that overlaps the blocking member 50 (the supply port 35*a* of the main body 31) in the expanse direction of the upper surface 31*c*. The end portions 152*c* of the branch portions 152*b* are bent and inserted between the upper surface 31*c* of the main body 31 and the mesh 47. With this configuration, the chemical supplied from the supply port 35*a* can be caused to spread in the expanse direction of the upper surface 31*c* preferentially toward the main body portion 152*a* and the two branch portions 152*b*. Accordingly, the chemical can be caused to spread more widely over a range in which the heater 80 is provided. As a result, the efficiency with which the chemical is heated by the heater 80 can be improved. Further, by bending the end portions 152*c* of the branch portions 152*b* and inserting the end portions 152*c* into gaps, the branch portions 152*b* can be held in close contact with the mesh 47 more easily.

Figure 12:
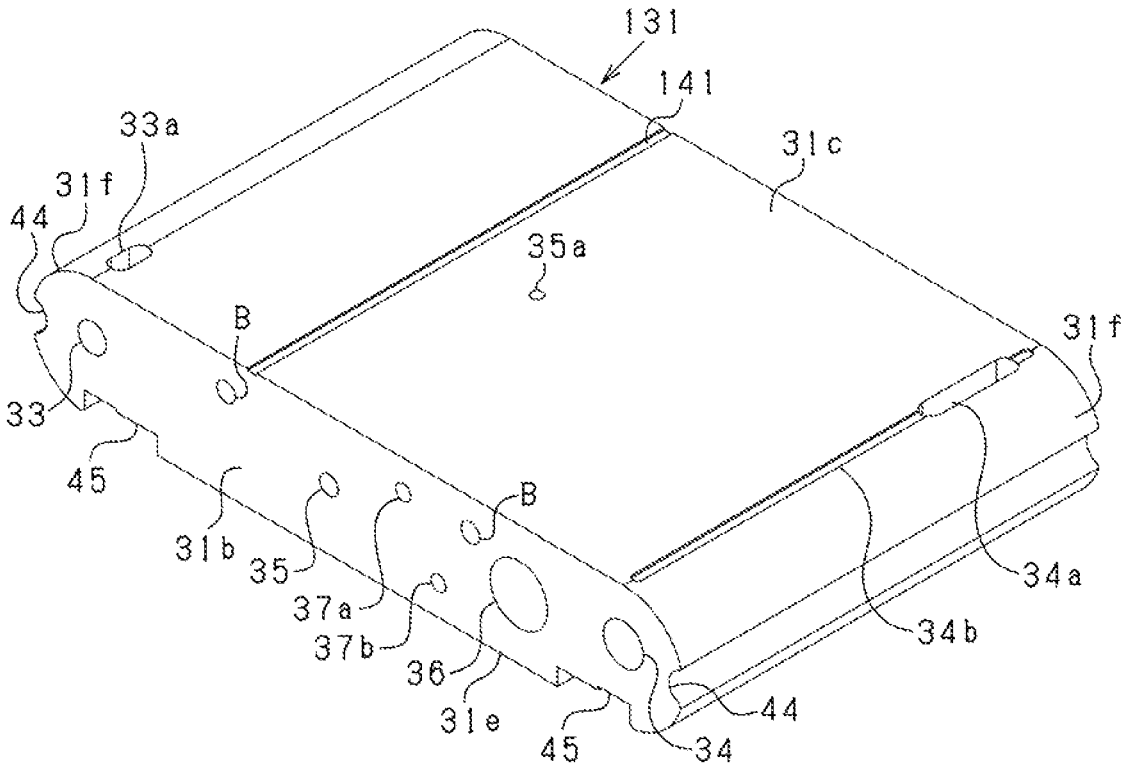
FIG. 12 is a perspective view showing a modified example of the main body of the liquid control apparatus.

FIG. 12 is a perspective view showing a modified example of the main body 31 of the liquid control apparatus 30. As shown in the drawing, the introduction port 33*a* and the discharge port 34*a* are formed in a main body 131 on a diagonal of the upper surface 31*c*. Likewise with this configuration, the inert gas introduced from the introduction port 33*a* passes over the supply port 35*a*, the thermocouple insertion holes 37*a* and 37*b* (the thermocouples 83 and 84), and the heater insertion hole 36 (the heater 80) in that order, and is then discharged from the discharge port 34*a*. As a result, spreading of the chemical from the supply port 35*a* to the sides of the heater 80 and the thermocouples 83 and 84 in the expanse direction of the upper surface 31*c* can be promoted by the inert gas.

Further, a suppression groove 141 that extends in the widthwise direction of the upper surface 31*c* of the main body 131 is formed in the upper surface 31*c* on the side opposite to the heater 80 and the thermocouples 83 and 84 with respect to the supply port 35*a*. With this configuration, spreading of the chemical from the supply port 35*a* to the side opposite to the heater 80 and the thermocouples 83 and 84 in the expanse direction of the upper surface 31*c* is suppressed. As a result, the amount of chemical flowing to the sides of the heater 80 and the thermocouples 83 and 84 in the expanse direction of the upper surface 31*c* can be increased such that spreading of the chemical to the sides of the heater 80 and the thermocouples 83 and 84 is promoted. Note that since the suppression groove 141 extends rectilinearly along the widthwise direction of the upper surface 31*c*, the configuration of the suppression groove 141 can be simplified.

Figure 13:
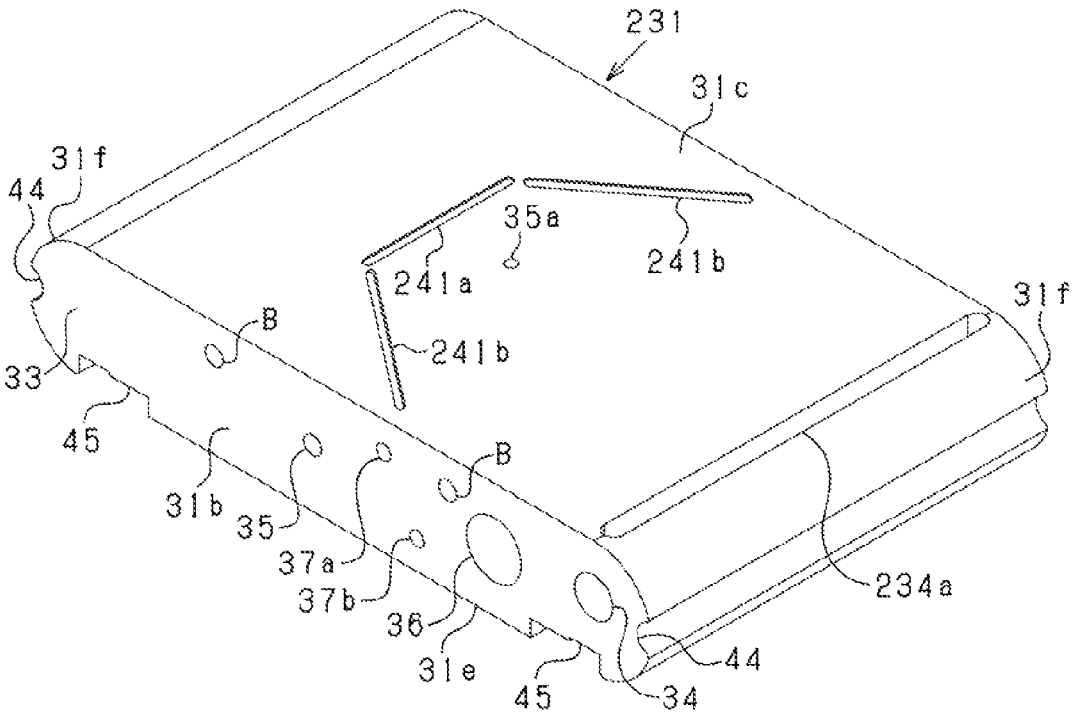
FIG. 13 is a perspective view showing another modified example of the main body of the liquid control apparatus.

FIG. 13 is a perspective view showing another modified example of the main body 31 of the liquid control apparatus 30. As shown in the drawing, a discharge port 234*a* is formed in a main body 231 in one lengthwise direction end of the upper surface 31*c*, while the introduction port 33*a* is not formed. In other words, the inert gas is introduced from the first housing 11 rather than an interior of the main body 231. More specifically, an inert gas introduction port is formed in an inner periphery of the first housing 11 in a position removed from the discharge port 234*a*. Likewise with this configuration, the inert gas introduced into the columnar space S can be discharged from the discharge port 234*a*. Further, the discharge port 234*a* is formed to extend around the entire widthwise direction length of the upper surface 31*c*, and therefore the mixed gas containing the inert gas and the vaporized chemical can be discharged from the discharge port 234*a* efficiently. Note that the inert gas may also be discharged from the first housing 11.

Further, suppression grooves 241*a* and 241*b* extending rectilinearly are formed individually in the upper surface 31*c* of the main body 231. The suppression grooves 241*a* and 241*b* surround the periphery of the supply port 35*a* in the expanse direction of the upper surface 31*c* on sides excluding the sides of the heater insertion hole 36 (the heater 80) and the thermocouple insertion holes 37*a* and 37*b* (the thermocouples 83 and 84). Likewise with this configuration, spreading of the chemical from the supply port 35*a* to the side opposite to the heater 80 and the thermocouples 83 and 84 in the expanse direction of the upper surface 31*c* is suppressed. As a result, the amount of chemical flowing to the sides of the heater 80 and the thermocouples 83 and 84 can be increased such that spreading of the chemical to the sides of the heater 80, and the thermocouples 83 and 84 is promoted. Furthermore, an interval between the two suppression grooves 241*b* in the expanse direction of the upper surface 31*c* increases toward the sides of the heater 80, and the thermocouples 83 and 84, and therefore the chemical can be caused to spread more widely over the range in which the heater 80 is provided.

Figure 14:
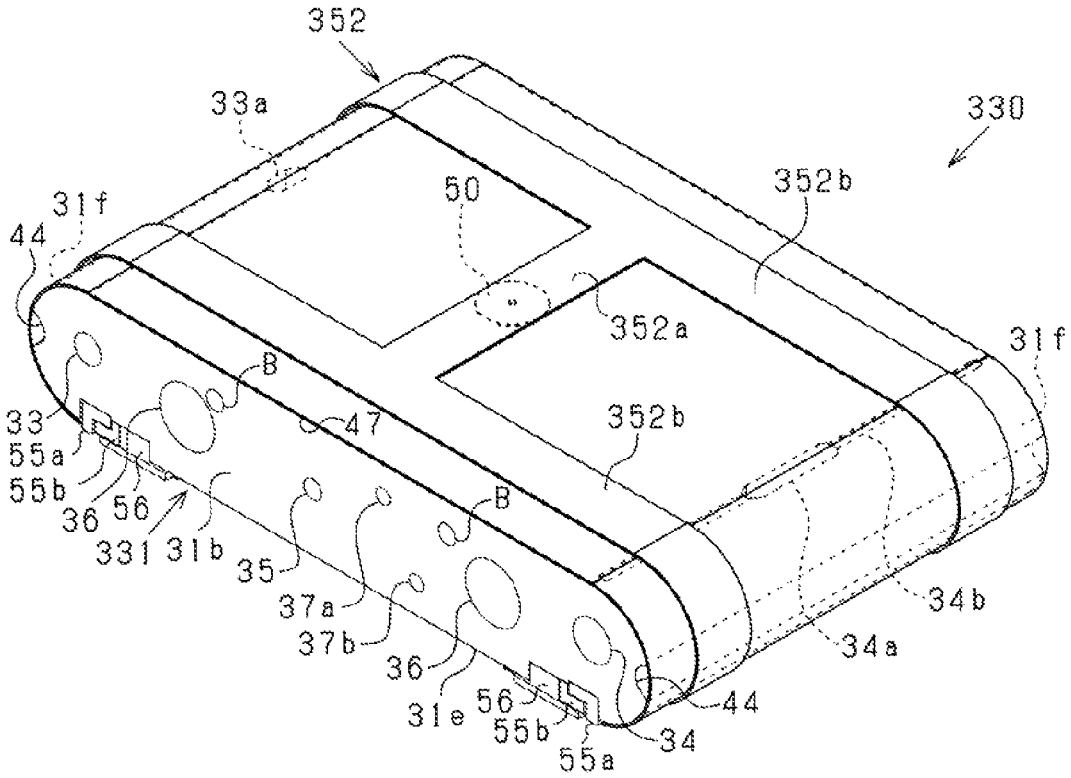
FIG. 14 is a perspective view showing a modified example of the liquid control apparatus.

FIG. 14 is a perspective view showing a modified example of the liquid control apparatus 30. As shown in the drawing, two heater insertion holes 36 are formed in a main body 331, and the heater 80 is inserted into each heater insertion hole 36. The entire upper surface 31*c* of the main body 331 is heated by the two heaters 80, and therefore the suppression groove 41 and so on are not formed in the upper surface 31*c*.

Further, an "H" shaped mesh band 352 is wrapped around the outer periphery of the mesh 47. A central portion 352*a* of the mesh band 352 is provided to extend in the widthwise direction of the upper surface 31*c* and to cover the blocking member 50 (the supply port 35*a*). Side portions 352*b* of the mesh band 352 are provided to extend in the lengthwise direction of the upper surface 31*c* close to the respective widthwise direction end portions of the upper surface 31*c*. The two side portions 352*b* are connected by the central portion 352*a*.

With this configuration, the chemical supplied from the supply port 35*a* is caused to spread preferentially in the widthwise direction of the upper surface 31*c* along the central portion 352*a*. Furthermore, the chemical is caused to spread preferentially in the lengthwise direction of the upper surface 31*c* along the side portions 352*b* connected to the central portion 352*a*. As a result, the chemical can be caused to spread efficiently to the side of the two heaters 80.

The blocking member 50 may be provided on the outer side of the mesh band 52, 152 and 352. Further, the shape of the blocking member 50 may be modified as desired as long as the blocking member 50 covers the supply port 35*a*. More specifically, various configurations to be described below may be employed in place of the blocking member 50. FIGS. 15 to 23 are plan views showing modified examples of the blocking member. Note that in FIGS. 15 to 23, the suppression groove 41 is not illustrated.

Figure 15:
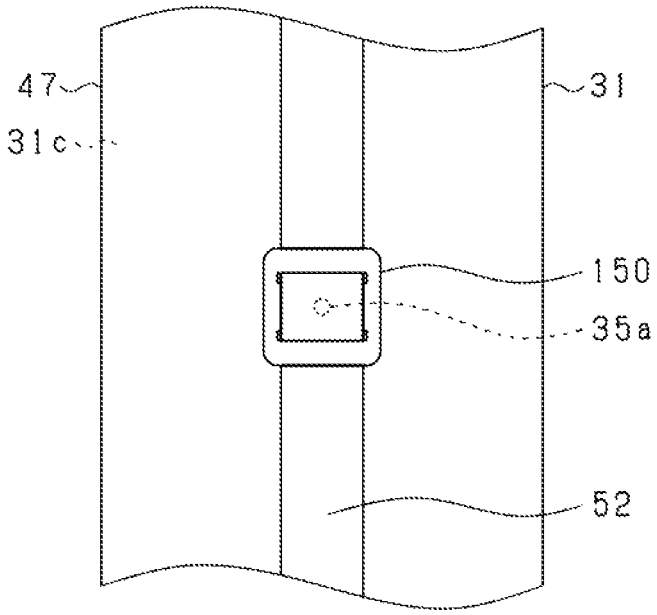
FIG. 15 is a plan view showing a modified example of the blocking member.
Figure 16:
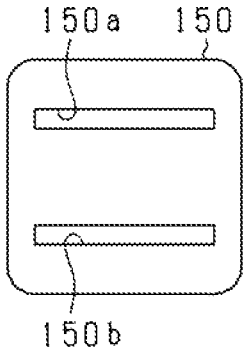
FIG. 16 is a plan view showing the modified example of the blocking member.

As shown in FIGS. 15 and 16, a blocking member 150 is formed in a square (rectangular) plate shape having sides that are longer than a widthwise direction length of the mesh band 52. The blocking member 150 is formed of chemical resistant stainless steel or the like at a thickness of 0.05 to 0.15 mm, or preferably 0.1 mm. Two through holes 150*a* and 150*b* extending parallel to each other are formed in the blocking member 150. The through holes 150*a* and 150*b* are formed in a rectangular shape having long sides that are slightly longer than the widthwise direction length of the mesh band 52 and short sides that are longer than the thickness of the mesh band 52.

The mesh band 52 is inserted into one of the through holes 150*a* and 150*b* from a lower side (a first surface side) of the blocking member 150, whereupon the inserted mesh band 52 is inserted into the other of the through holes 150*a* and 150*b* from an upper side (a second surface side) of the blocking member 150. As a result, the blocking member 150 is attached to the mesh band 52. When the mesh band 52 is attached to the main body 31, the blocking member 150 covers the supply port 35*a*.

With this configuration, the mesh band 52 is inserted into the through holes 150*a* and 150*b* formed in the blocking member 150, and therefore the blocking member 150 can be prevented from deviating from the supply port 35*a* even when the pressure of the chemical acts on the blocking member 150. Moreover, since the mesh band 52 is simply inserted into the through holes 150*a* and 150*b* of the blocking member 150, the blocking member 150 can be attached to the mesh band 52 easily.

Figure 17:
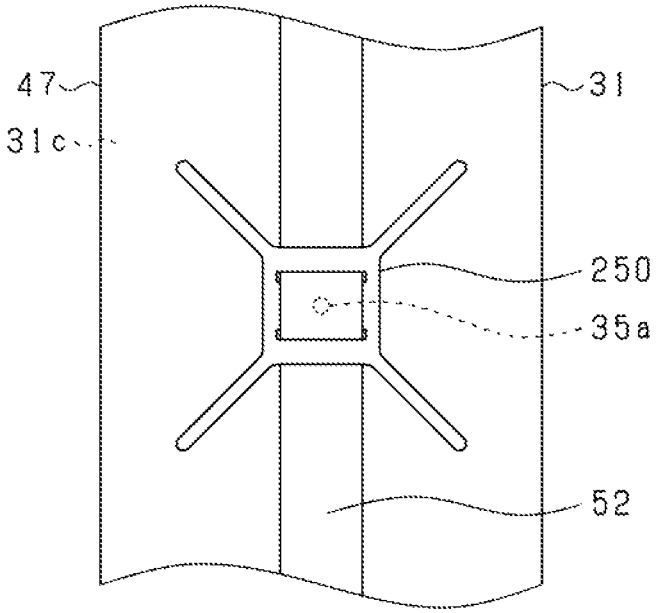
FIG. 17 is a plan view showing another modified example of the blocking member.
Figure 18:
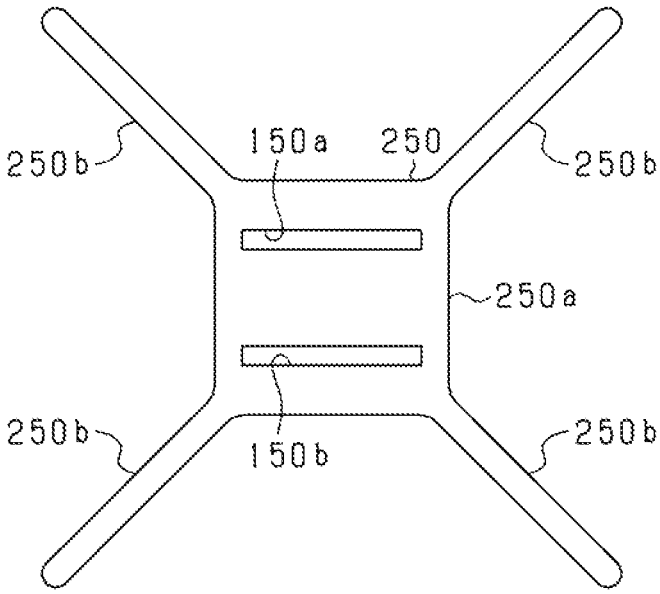
FIG. 18 is a plan view showing another modified example of the blocking member.

As shown in FIGS. 17 and 18, a blocking member 250 is formed in a plate shape, and includes a square (rectangular) main body portion 250*a*, and projecting portions 250*b* that project outwardly from an outer edge of the main body portion 250*a* in an expanse direction of the main body portion 250*a*. The main body portion 250*a* is configured similarly to the blocking member 150 described above. The projecting portions 250*b* are provided in a plurality so as to project at predetermined intervals from the outer edge of the main body portion 250*a*. More specifically, the projecting portions 250*b* project rectilinearly from the main body portion 250*a* at opposing positions each other, or in other words radially from the center of the supply port 35*a*. The blocking member 250 is attached to the mesh band 52 similarly to the blocking member 150.

With this configuration, similar effects to those of the blocking member 150 can be obtained. Further, the chemical supplied from the supply port 35*a* so as to impinge on the main body portion 250*a* of the blocking member 250 travels along the projecting portions 250*b* so as to spread in the expanse direction of the upper surface 31*c*. As a result, spreading of the chemical in the expanse direction of the upper surface 31*c* can be promoted even further. In addition, the projecting portions 250*b* project radially from the center of the supply port 35*a*, and therefore the chemical can be spread evenly in the expanse direction of the upper surface 31*c*.

Figure 19:
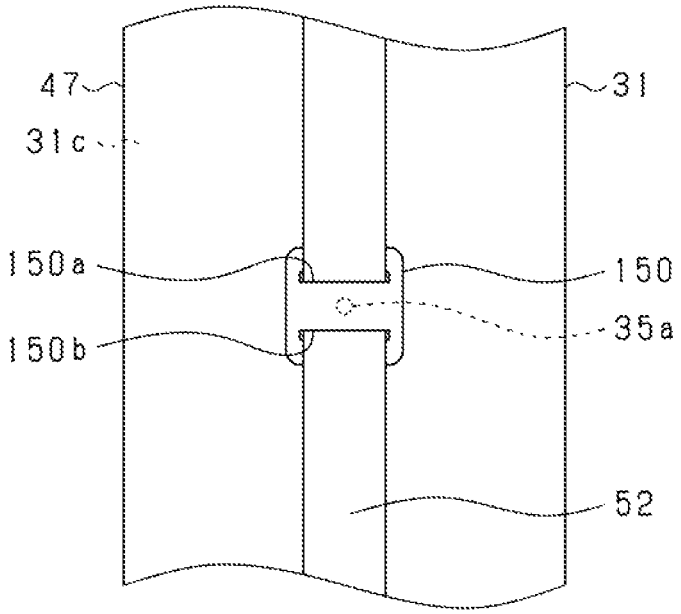
FIG. 19 is a plan view showing another modified example of the blocking member.

As shown in FIG. 19, the blocking member 150 shown in FIGS. 15 and 16 can be attached to the mesh band 52 in a different manner. More specifically, the mesh band 52 is inserted into one of the through holes 150*a* and 150*b* from the upper side (the first surface side) of the blocking member 150, whereupon the inserted mesh band 52 is inserted into the other of the through holes 150*a* and 150*b* from the lower side (the second surface side) of the blocking member 150. As a result, the blocking member 150 is attached to the mesh band 52. With this configuration, similar effects to those of the blocking member 150 shown in FIGS. 15 and 16 can be obtained.

Figure 20:
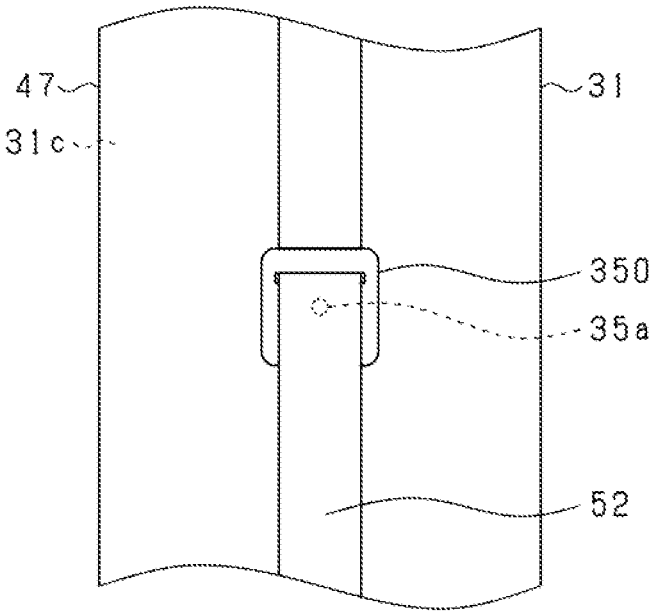
FIG. 20 is a plan view showing another modified example of the blocking member.
Figure 21:
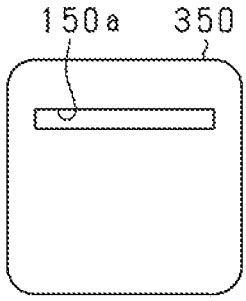
FIG. 21 is a plan view showing another modified example of the blocking member.

As shown in FIGS. 20 and 21, a blocking member 350 formed with only one through hole 150*a* may be employed. The blocking member 350 is formed by omitting the through hole 150*b* from the blocking member 150 shown in FIGS. 15 and 16. The mesh band 52 is inserted into the through hole 150*a* from the lower side of the blocking member 350 and an outer edge side of the blocking member 350 close to the through hole 150*a*, whereupon the inserted mesh band 52 is passed over the upper side of the blocking member 350 to the opposite outer edge side. As a result, the blocking member 350 is attached to the mesh band 52. Further, a similar configuration to that shown in FIGS. 20 and 21 can be obtained in FIGS. 15 and 16 by inserting the mesh band 52 into only one through hole 150*a*. Likewise with this configuration, effects corresponding to those of the blocking member 150 shown in FIGS. 15 and 16 can be obtained.

Figure 22:
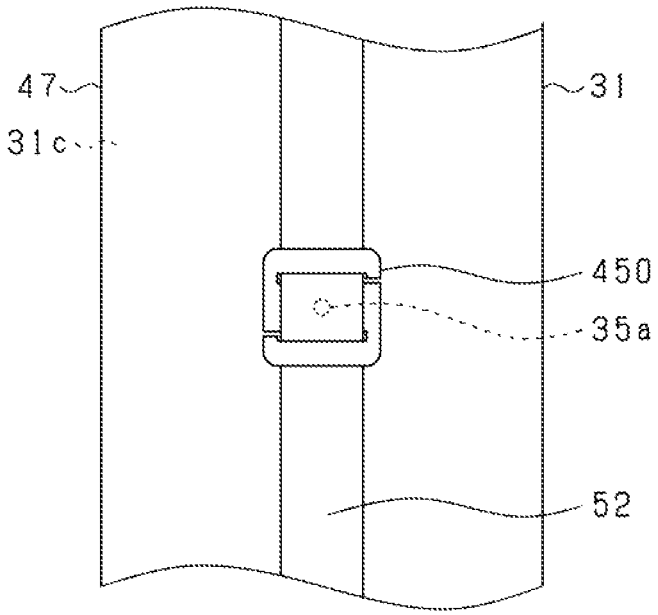
FIG. 22 is a plan view showing another modified example of the blocking member.
Figure 23:
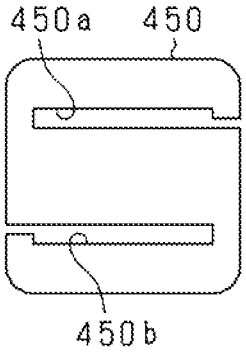
FIG. 23 is a plan view showing another modified example of the blocking member.

As shown in FIGS. 22 and 23, a blocking member 450 formed with cutouts 450*a* and 450*b* instead of the through holes 150*a* and 150*b* may also be employed. The blocking member 450 is configured as the blocking member 150 shown in FIGS. 15 and 16 by cutting away one lengthwise direction end portion side of the through hole 150*a* and one lengthwise direction end portion side of the through hole 150*b* up to end portions of the blocking member 450. In other words, the cutouts 450*a* and 450*b* are formed in the blocking member 450 to extend alternately and in parallel from two opposing sides. Note that the cutouts 450*a*, 450*b* may be formed to extend in parallel from an identical side of the blocking member 450.

The mesh band 52 is inserted into one of the cutouts 450*a* and 450*b* from a lower side (a first surface side) of the blocking member 450, whereupon the inserted mesh band 52 is inserted into the other of the cutouts 450*a* and 450*b* from an upper side (a second surface side) of the blocking member 450. As a result, the blocking member 450 is attached to the mesh band 52. Likewise with this configuration, effects corresponding to those of the blocking member 150 shown in FIGS. 15 and 16 can be obtained. Moreover, the mesh band 52 is inserted into the cutouts 450*a* and 450*b* rather than the through holes 150*a* and 150*b*, and therefore the blocking member 450 can be attached to the mesh band 52 after attaching the mesh band 52 to the main body 31.

Note that similarly to FIG. 19, the blocking member 450 shown in FIGS. 22 and 23 may be attached to the mesh band 52 in a different manner. More specifically, the mesh band 52 may be inserted into one of the cutouts 450*a* and 450*b* from the upper side (the first surface side) of the blocking member 450, whereupon the inserted mesh band 52 is inserted into the other of the cutouts 450*a* and 450*b* from the lower side (the second surface side) of the blocking member 150.

A method of knitting (weaving) the mesh 47, and the mesh band 52, 152 and 352 is not limited to plain weave, and another weaving method such as diagonal weave may be employed. Further, the mesh size of the mesh 47, and the mesh band 52, 152 and 352 is preferably set appropriately within a range of approximately 100 to 500 mesh in accordance with the wettability thereof relative to the chemical, the chemical wettability of the main body 31, the viscosity of the chemical, and so on.

In the embodiments described above, the mesh band 52, 152 and 352 is woven into mesh form, but the mesh band 52, 152 and 352 may be formed in film form. In this case, the film form band functions as the blocking member 50, and therefore the blocking member 50 may be omitted. The blocking member 50 may also be omitted in cases where a supply pressure of the chemical is low such that the chemical is unlikely to spurt out through the mesh 47, and the mesh band 52, 152 and 352. Conversely, the mesh band 52, 152 and 352 may be omitted from the part in which the blocking member 50 is provided. In other words, the mesh band 52, 152 and 352 may be provided only in parts where the blocking member 50 is not provided. Note that the mesh band 52, 152 and 352 may also be formed in plate form.

The shape of the main body 31 is not limited to a columnar shape having an oval bottom surface, and another shape, such as a rectangular parallelepiped shape, may be employed. Further, the upper surface 31*c* (the supply subject surface) of the main body 31 is not limited to a planar surface, and a curved surface may be employed instead.

The chemical is not limited to a hydrophobicity processing liquid (HMDS), and another chemical such as a thinner-based solvent or a silane coupling agent may be employed instead. In this case, the materials of the mesh 47, and the mesh band 52, 152 and 352 are preferably modified in accordance with the wettability relative to the chemical. A metal other than a stainless steel material, a resin, or the like, for example, may be used as these materials. Further, the liquid control apparatus 30 is not limited to the liquid vaporizer 10, and may be applied to another apparatus such as a liquid coater or a film forming apparatus.

The invention claimed is:

1. A liquid control apparatus controlling a spread of a liquid, the apparatus comprising:

a main body having a supply subject surface onto which the liquid is supplied;

a mesh form body woven into a mesh form and provided to contact the supply subject surface; and a guiding member provided to contact an opposite side of the mesh form body with respect to the main body.

2. The liquid control apparatus according to claim 1, wherein the guiding member is formed by being woven into a mesh form.

3. The liquid control apparatus according to claim 1, wherein a supply port is provided in the main body to supply the liquid from an interior of the main body to a part of the supply subject surface contacted by the mesh form body.

4. The liquid control apparatus according to claim 3, wherein the mesh form body and the guiding member are provided to cover the supply port.

5. The liquid control apparatus according to claim 3, wherein a blocking member formed in a plate form or a film form is provided to cover the supply port.

6. The liquid control apparatus according to claim 5, wherein the blocking member is provided to cover only the supply port and a vicinity of the supply port.

7. The liquid control apparatus according to claim 5, wherein a through hole is formed in the blocking member, and the guiding member is inserted into the through hole.

8. The liquid control apparatus according to claim 1, wherein a heater configured to heat the supply subject surface is provided in an interior of the main body, and the guiding member extends toward the heater in an expanse direction of the supply subject surface.

9. The liquid control apparatus according to claim 8, wherein a supply port is provided in the main body to supply the liquid from an interior of the main body to a part of the supply subject surface contacted by the mesh form body, and the guiding member extends toward the heater from the supply port in the expanse direction of the supply subject surface.

10. The liquid control apparatus according to claim 1, wherein a heater configured to heat the supply subject surface is provided in an interior of the main body, a supply port is provided in the main body to supply the liquid from the interior of the main body to a part of the supply subject surface contacted by the mesh form body, and a groove is provided in the supply subject surface to suppress spreading of the liquid from the supply port to a side opposite to the heater in an expanse direction of the supply subject surface.

11. The liquid control apparatus according to claim 1, wherein a heater configured to heat the supply subject surface is provided in an interior of the main body, a supply port is provided in the main body to supply the liquid from the interior of the main body to a part of the supply subject surface contacted by the mesh form body, and a groove is provided in the supply subject surface to surround a periphery of the supply port on sides excluding a side of the heater in an expanse direction of the supply subject surface.

12. The liquid control apparatus according to claim 8, wherein an introduction port and a discharge port for a gas are provided in the main body, the introduction port is an opening for introducing the gas into a space on a periphery of the supply subject surface from the interior of the main body, the discharge port is an opening for discharging the gas into the interior of the main body from the space, and the introduction port is provided on a side opposite to the discharge port across the heater in the expanse direction of the supply subject surface.

13. The liquid control apparatus according to claim 12, wherein a supply port configured to supply the liquid from the interior of the main body to a part of the supply subject surface contacted by the mesh form body is provided in the main body between the introduction port and the heater in the expanse direction of the supply subject surface.

14. The liquid control apparatus according to claim 1, wherein a temperature sensor is provided in an interior of the main body to detect a temperature of the supply subject surface, and the guiding member extends toward the temperature sensor in an expanse direction of the supply subject surface.

15. The liquid control apparatus according to claim 14, wherein a supply port is provided in the main body to supply the liquid from the interior of the main body to a part of the supply subject surface contacted by the mesh form body, and the guiding member extends from the supply port toward the temperature sensor in the expanse direction of the supply subject surface.

16. The liquid control apparatus according to claim 1, wherein a temperature sensor is provided in an interior of the main body to detect a temperature of the supply subject surface, a supply port is provided in the main body to supply the liquid from the interior of the main body to a part of the supply subject surface contacted by the mesh form body, and a groove is provided in the supply subject surface to suppress spreading of the liquid from the supply port to a side opposite to the temperature sensor in an expanse direction of the supply subject surface.

17. The liquid control apparatus according to claim 1, wherein a temperature sensor is provided in an interior of the main body to detect a temperature of the supply subject surface, a supply port is provided in the main body to supply the liquid from the interior of the main body to a part of the supply subject surface contacted by the mesh form body, and a groove is provided in the supply subject surface to surround a periphery of the supply port on sides excluding a side of the temperature sensor in an expanse direction of the supply subject surface.

18. The liquid control apparatus according to claim 14, wherein an introduction port and a discharge port for a gas are provided in the main body, the introduction port is an opening for introducing the gas into a space on a periphery of the supply subject surface from the interior of the main body, the discharge port is an opening for discharging the gas into the interior of the main body from the space, and the introduction port is provided on a side opposite to the discharge port across the temperature sensor in the expanse direction of the supply subject surface.

19. The liquid control apparatus according to claim 18, wherein a supply port supplying the liquid from the interior of the main body to a part of the supply subject surface contacted by the mesh form body is provided in the main body between the introduction port and the temperature sensor in the expanse direction of the supply subject surface.

* * * * *